US011336015B2

(12) United States Patent
Thai et al.

(10) Patent No.: US 11,336,015 B2
(45) Date of Patent: May 17, 2022

(54) ANTENNA BOARDS AND COMMUNICATION DEVICES

(71) Applicant: Intel IP Corporation, Santa Clara, CA (US)

(72) Inventors: Trang Thai, Hillsboro, OR (US); Sidharth Dalmia, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 896 days.

(21) Appl. No.: 15/939,180

(22) Filed: Mar. 28, 2018

(65) Prior Publication Data

US 2019/0305430 A1 Oct. 3, 2019

(51) Int. Cl.

| | |
|---|---|
| ***H01Q 9/04*** | (2006.01) |
| ***H01Q 19/13*** | (2006.01) |
| ***H01Q 21/00*** | (2006.01) |

(52) U.S. Cl.

CPC ..... *H01Q 9/0414* (2013.01); *H01Q 19/138* (2013.01); *H01Q 21/0068* (2013.01); *H01Q 9/045* (2013.01)

(58) Field of Classification Search

CPC .... H01Q 9/0414; H01Q 9/045; H01Q 9/0457; H01Q 21/0043; H01Q 21/005; H01Q 21/0075; H01Q 21/065; H01Q 21/29; H01Q 21/293; H01Q 21/068; H01Q 21/245; H01Q 19/138; H01Q 1/2283

See application file for complete search history.

(56) References Cited

U.S. PATENT DOCUMENTS

| | | | | |
|---|---|---|---|---|
| 6,809,688 | B2 * | 10/2004 | Yamada | H01Q 1/243 343/700 MS |
| 7,265,719 | B1 | 9/2007 | Moosbrugger et al. | |
| 7,289,069 | B2 | 10/2007 | Ranta | |
| 9,196,965 | B2 * | 11/2015 | Sabielny | H01Q 9/0414 |
| 9,425,502 | B2 | 8/2016 | Chen et al. | |
| 9,620,464 | B2 * | 4/2017 | Baks | H01Q 19/10 |
| 11,011,827 | B2 | 5/2021 | Thai et al. | |
| 2002/0122006 | A1 | 9/2002 | Crawford | |
| 2005/0245001 | A1 | 11/2005 | Hyvonen et al. | |
| 2006/0001572 | A1 | 1/2006 | Gaucher et al. | |
| 2007/0126638 | A1 | 6/2007 | Channabasappa | |
| 2007/0159380 | A1 | 7/2007 | Nagaishi et al. | |

(Continued)

FOREIGN PATENT DOCUMENTS

| | | |
|---|---|---|
| CN | 111869008 A | 10/2020 |
| CN | 111886755 | 11/2020 |

(Continued)

OTHER PUBLICATIONS

Notice of Allowance in U.S. Appl. No. 16/000,795 dated Jun. 11, 2020, 9 pages.

(Continued)

*Primary Examiner* — Hoang V Nguyen
(74) *Attorney, Agent, or Firm* — Patent Capital Group

(57) ABSTRACT

Disclosed herein are antenna boards, antenna modules, and communication devices. For example, in some embodiments, an antenna board may include: a substrate including an antenna feed structure; an antenna patch, wherein the antenna patch is a millimeter wave antenna patch; and an air cavity between the antenna patch and the substrate.

20 Claims, 12 Drawing Sheets

(56) References Cited

U.S. PATENT DOCUMENTS

| | | | | |
|---|---|---|---|---|
| 2009/0256752 | A1* | 10/2009 | Akkermans | H01Q 21/061 343/700 MS |
| 2009/0303135 | A1 | 12/2009 | Reed et al. | |
| 2010/0073238 | A1 | 3/2010 | Jun et al. | |
| 2010/0113111 | A1 | 5/2010 | Wong et al. | |
| 2010/0164783 | A1 | 7/2010 | Choudhury et al. | |
| 2010/0327068 | A1* | 12/2010 | Chen | H01L 23/66 235/492 |
| 2011/0079917 | A1 | 4/2011 | Xia et al. | |
| 2012/0119954 | A1 | 5/2012 | Chen | |
| 2012/0235881 | A1 | 9/2012 | Pan et al. | |
| 2013/0016023 | A1 | 1/2013 | Gaucher et al. | |
| 2013/0118008 | A1 | 5/2013 | Gaynes et al. | |
| 2013/0207274 | A1 | 8/2013 | Liu et al. | |
| 2014/0145883 | A1 | 5/2014 | Baks et al. | |
| 2015/0129668 | A1 | 5/2015 | Kam et al. | |
| 2015/0364815 | A1 | 12/2015 | Yong et al. | |
| 2016/0049723 | A1 | 2/2016 | Baks et al. | |
| 2016/0172761 | A1 | 6/2016 | Garcia et al. | |
| 2016/0261047 | A1 | 9/2016 | Wallace et al. | |
| 2017/0125895 | A1 | 5/2017 | Baks et al. | |
| 2017/0214121 | A1 | 7/2017 | Ganchrow et al. | |
| 2018/0026341 | A1 | 1/2018 | Mow et al. | |
| 2018/0034134 | A1 | 2/2018 | Dalmia | |
| 2018/0090816 | A1 | 3/2018 | Mow et al. | |
| 2019/0037229 | A1 | 1/2019 | Kim et al. | |
| 2019/0131691 | A1 | 5/2019 | Hong et al. | |
| 2019/0181126 | A1 | 6/2019 | Cheah et al. | |
| 2019/0260110 | A1 | 8/2019 | Thai et al. | |
| 2019/0305402 | A1 | 10/2019 | Dalmia et al. | |
| 2019/0348749 | A1 | 11/2019 | Thai et al. | |
| 2019/0372198 | A1 | 12/2019 | Dalmia et al. | |
| 2020/0403316 | A1 | 12/2020 | Dalmia et al. | |
| 2021/0234260 | A1 | 7/2021 | Thai et al. | |

FOREIGN PATENT DOCUMENTS

| | | | |
|---|---|---|---|
| EP | 1777551 | A2 | 4/2007 |
| JP | 2005019649 | A | 1/2005 |
| JP | 2009065321 | A | 3/2009 |
| KR | 200406775 | Y1 | 1/2006 |
| KR | 20170016377 | A | 2/2017 |
| KR | 101780024 | B1 | 9/2017 |
| WO | 2011031668 | A1 | 3/2011 |

OTHER PUBLICATIONS

United States Patent Application filed Jun. 5, 2018 in U.S. Appl. No. 16/000,795, 54 pages.
United States Patent Application filed Mar. 28, 2018 in U.S. Appl. No. 15/939,139, 48 pages.
United States Patent Application filed Mar. 29, 2018 in U.S. Appl. No. 15/939,806, 64 pages.
United States Patent Application filed May 11, 2018 in U.S. Appl. No. 15/977,612, 57 pages.
United States Patent Application in U.S. Appl. No. 15/991,295, filed May 29, 2018, 52 pages.
International Search Report and Written Opinion in International Patent Application No. PCT/US2019/026904 dated Jul. 26, 2019, 14 pages.
Non Final Office Action in U.S. Appl. No. 15/939,139 dated Dec. 23, 2020, 16 pages.
Notice of Allowance in U.S. Appl. No. 15/977,612 dated Jan. 25, 2021, 9 pages.
Abbosh, Ayman, et al., "Flexible CPW-IFA antenna for wearable electronic devices," 2014 IEEE Antennas and Propagation Society International Symposium [online], Sep. 22, 2014 [retrieved on Jul. 19, 2019]. Retrieved from the Internet.
Hong, Wonbin "Millimeter-Wave Antennas and Arrays'," Handbook of Antenna Technologies [online], Sep. 16, 2016 [retrieved on Jul. 19, 2019]. Retrieved from the Internet.
International Search Report and Written Opinion in International Patent Application No. PCT/US2019/026904 dated Aug. 22, 2019, 14 pages.
International Search Report and Written Opinion in International Patent Application No. PCT/US2019/029581 dated Aug. 13, 2019, 12 pages.
International Search Report and Written Opinion in International Patent Application No. PCT/US2019/020057 dated Jun. 14, 2019, 12 pages.
International Search Report and Written Opinion in International Patent Application No. PCT/US2019/020066 dated Jun. 24, 2019, 11 pages.
International Search Report an Written Opinion in International Patent Application No. PCT/US2019/014645 dated May 15, 2019, 11 pages.
Non Final Office Action in U.S. Appl. No. 15/939,806 dated Jul. 6, 2021, 17 pages.

* cited by examiner

ANTENNA BOARDS AND COMMUNICATION DEVICES

BACKGROUND

Wireless communication devices, such as handheld computing devices and wireless access points, include antennas. The frequencies over which communication may occur may depend on the shape and arrangement of the antennas, among other factors.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example, not by way of limitation, in the figures of the accompanying drawings.

DETAILED DESCRIPTION

Figure 1:
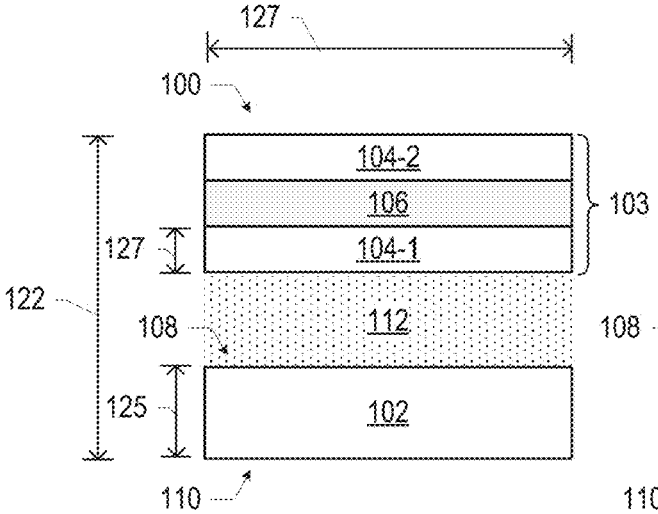
FIGS. 1 and 2 are generalized representations of side views of example antenna boards, in accordance with various embodiments.

Disclosed herein are antenna boards, antenna modules, and communication devices. For example, in some embodiments, an antenna board may include: a substrate including an antenna feed structure; an antenna patch, wherein the antenna patch is a millimeter wave antenna patch; and an air cavity between the antenna patch and the substrate.

At millimeter wave frequencies, antenna arrays integrated into electronic devices (e.g., mobile devices, such as handheld phones) may suffer significant losses due to de-tuning, absorption, and/or radiation pattern distortion. For example, in a mobile device environment, an antenna array may be inside a housing that includes a plastic or glass back cover, a metallic chassis, a metallic front display, and/or a metallic phone edge. The antenna array(s) may be located proximate to the phone edge. For conventional antennas designed for free space operation, operation in such a "real" electronic device environment may experience losses due to mismatch between the power amplifier signal and the antenna terminal, undesired reflection and surface waves at the glass/air interface (which may result in low radiation efficiency and radiation pattern distortion that induces undesired side lobes), and/or dielectric absorption of the plastic or glass back cover (which may also contribute to low radiation efficiency).

Various ones of the antenna boards disclosed herein may exhibit improved performance to enable millimeter wave operation in mobile device and other electronic device environments. For example, the antenna board designs and fabrication techniques disclosed herein may enable the antenna boards disclosed herein to achieve broad bandwidth operation with high return loss and high gain. As discussed below, the low cost, high yield techniques and designs disclosed herein may allow air cavities to be introduced into the antenna topologies to improve the impedance bandwidth and radiation efficiency over the operational bandwidth. Further various ones of the antenna boards disclosed herein may exhibit little to no warpage during operation or installation, ease of assembly, low cost, fast time to market, and/or good mechanical handling. The antenna boards disclosed herein may be advantageously included in mobile devices, base stations, access points, routers, backhaul communication links, and other communication devices.

In the following detailed description, reference is made to the accompanying drawings that form a part hereof wherein like numerals designate like parts throughout, and in which is shown, by way of illustration, embodiments that may be practiced. It is to be understood that other embodiments may be utilized, and structural or logical changes may be made, without departing from the scope of the present disclosure. Therefore, the following detailed description is not to be taken in a limiting sense.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order from the described embodiment. Various additional operations may be performed, and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B, and C). The drawings are not necessarily to scale. Although many of the drawings illustrate rectilinear structures with flat walls and right-angle corners, this is simply for ease of illustration, and actual devices made using these techniques will exhibit rounded corners, surface roughness, and other features.

The description uses the phrases "in an embodiment" or "in embodiments," which may each refer to one or more of the same or different embodiments. Furthermore, the terms "comprising," "including," "having," and the like, as used with respect to embodiments of the present disclosure, are synonymous. As used herein, a "package" and an "integrated circuit (IC) package" are synonymous. When used to describe a range of dimensions, the phrase "between X and Y" represents a range that includes X and Y. For convenience, the phrase "FIG. 12" may be used to refer to the collection of drawings of FIGS. 12A-12D.

Any of the features discussed with reference to any of accompanying drawings herein may be combined with any other features to form an antenna board 100, an antenna module 105, or a communication device, as appropriate. A number of elements of the drawings are shared with others of the drawings; for ease of discussion, a description of these elements is not repeated, and these elements may take the form of any of the embodiments disclosed herein.

Figure 2:
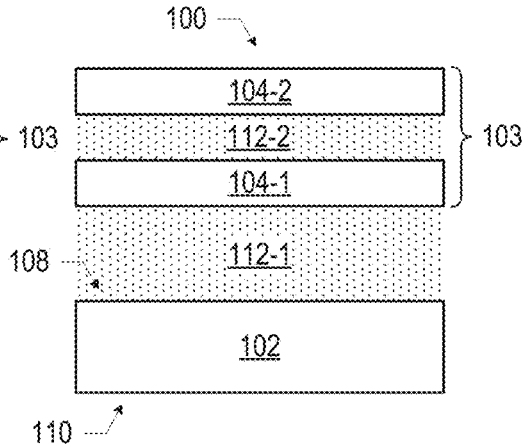

FIGS. 1 and 2 are generalized representations of side views of example antenna boards 100, in accordance with various embodiments. An antenna board 100 may include an antenna feed substrate 102 and one or more antenna patches 104. The antenna feed substrate 102 may include conductive pathways (e.g., provided by conductive vias and lines through one or more dielectric materials, not shown in FIGS. 1 and 2) and radio frequency (RF) transmission structures (e.g., antenna feed structures, not shown in FIGS. 1 and 2) that may enable one or more antenna patches 104 to transmit and receive electromagnetic waves (e.g., under the control of other circuitry, not shown, such as circuitry in an IC package 115 that is part of an antenna module 105, discussed below). In some embodiments, at least a portion of the antenna feed substrate 102 may be fabricated using printed circuit board (PCB) technology, and may include between two and eight PCB layers.

In the embodiments of FIGS. 1 and 2, the antenna patch 104-1 may be spaced apart from a top face 108 of the antenna feed substrate 102 by an air cavity 112. In particular, in the embodiment of FIG. 1, the antenna patch 104-1 may be spaced apart from the antenna patch 104-2 by a patch board 106, while in the embodiment of FIG. 2, the antenna patch 104-1 may be spaced apart from a top face 108 of the antenna feed substrate 102 by an air cavity 112-1, and the antenna patch 104-1 may be spaced apart from the antenna patch 104-2 by an air cavity 112-2. A patch board 106 may have any suitable structure; for example, in some embodiments, a patch board 106 may be a PCB, or a non-conductive plastic structure. Some of the embodiments disclosed herein may be examples of the antenna boards 100 of both FIGS. 1 and 2, as the antenna patches 104 may be spaced apart by both a patch board 106 and an air cavity 112 (e.g., as discussed below with reference to FIGS. 9-11).

In some embodiments, the antenna patches 104 may be electrically coupled to the antenna feed substrate 102 by electrically conductive material pathways through the antenna feed substrate 102 that make conductive contact with electrically conductive material of the antenna patches 104, while in other embodiments, the antenna patches 104 may be mechanically coupled to the antenna feed substrate 102 but may not be in contact with an electrically conductive material pathway through the antenna feed substrate 102. Various examples of these embodiments are discussed below. Generally, any of the embodiments disclosed herein in which the antenna feed substrate 102 is not coupled to one or more of the antenna patches 104 by an electrically conductive material pathway may be modified to include such a pathway (e.g., using a mechanical connection provided by solder 140 to also feed the one or more antenna patches 104).

Figure 11:
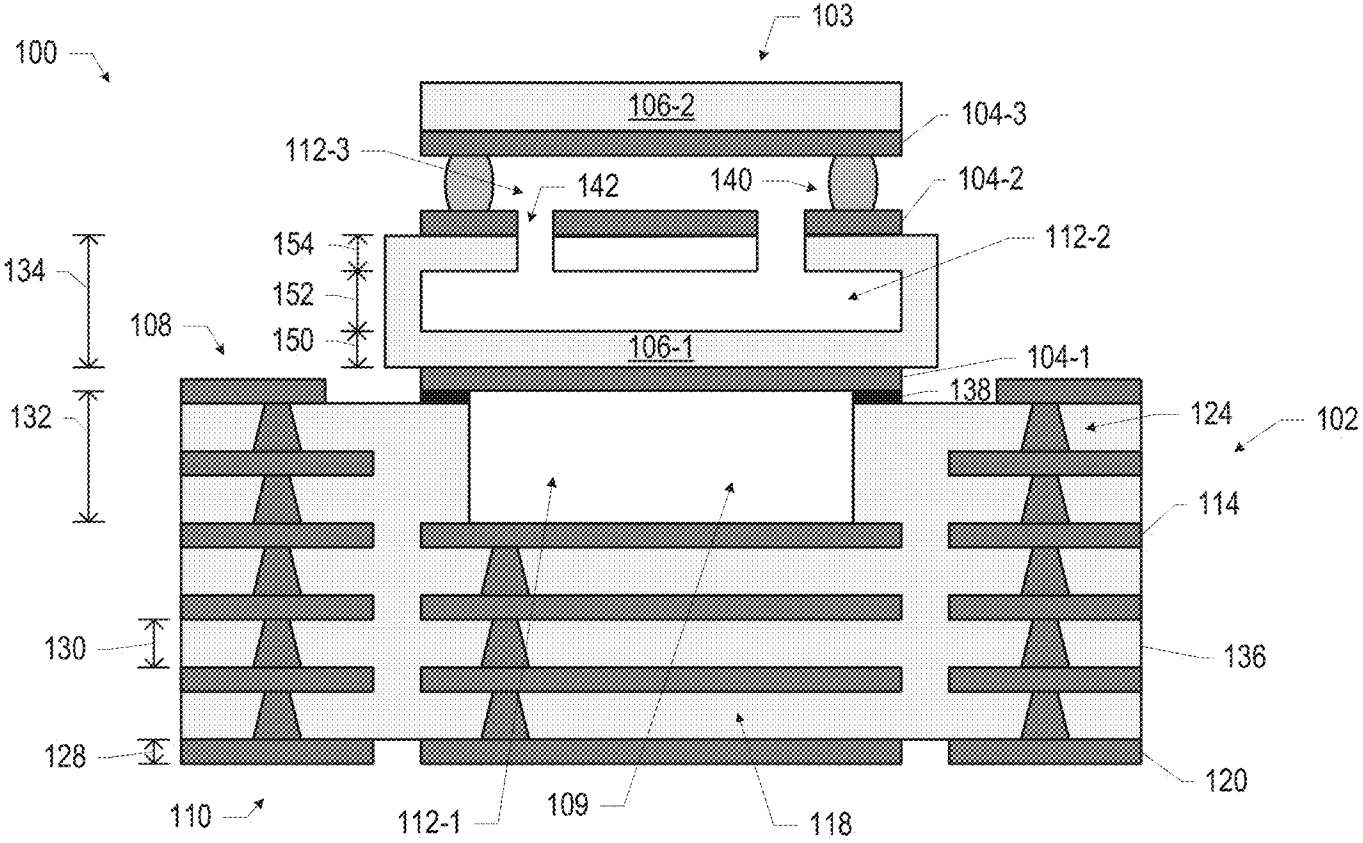

FIGS. 1 and 2 each illustrate antenna boards 100 with two antenna patches, 104-1 and 104-2, arranged in a stack 103. In some embodiments, a stack 103 of antenna patches 104 may include fewer than two antenna patches 104, or more than two antenna patches 104 (e.g., as illustrated in FIG. 11 and discussed below). Further, although a single stack 103 of antenna patches 104 is depicted in FIGS. 1 and 2 (and others of the accompanying drawings), this is simply illustrative, and an antenna board 100 may include more than one stack 103 of antenna patches 104 (e.g., arranged in an array on a face 108 of the antenna feed substrate 102). For example, an antenna board 100 may include four stacks 103 (e.g., arranged in a linear array), eight stacks 103 (e.g., arranged in one linear array, or two linear arrays), sixteen stacks 103 (e.g., arranged in a 4×4 array), or thirty-two stacks 103 (e.g., arranged in two 4×4 arrays). A stack 103 of antenna patches 104 may exhibit higher gain and higher directivity than a single antenna patch 104, and the gain and directivity improvements may increase with the number of antenna patches 104 in the stack 103.

The dimensions of the antenna boards 100 disclosed herein may take any suitable values. For example, in some embodiments, a thickness 125 of the antenna feed substrate 102 may be less than 1 millimeter (e.g., between 0.35 millimeters and 0.5 millimeters). In some embodiments, a thickness 127 of an antenna patch 104 may be less than a quarter of the wavelength of the center frequency to be transmitted/received. For example, a thickness 127 of an antenna patch 104 may be less than 1 millimeter (e.g., between 0.4 millimeters and 0.7 millimeters). In some embodiments, a lateral dimension 129 of an antenna patch 104 may be less than half of the wavelength of the center frequency to be transmitted/received. In some embodiments, a thickness 122 of the antenna board 100 may be between 500 microns and 2 millimeters (e.g., between 700 microns and 1 millimeter).

Figure 3:
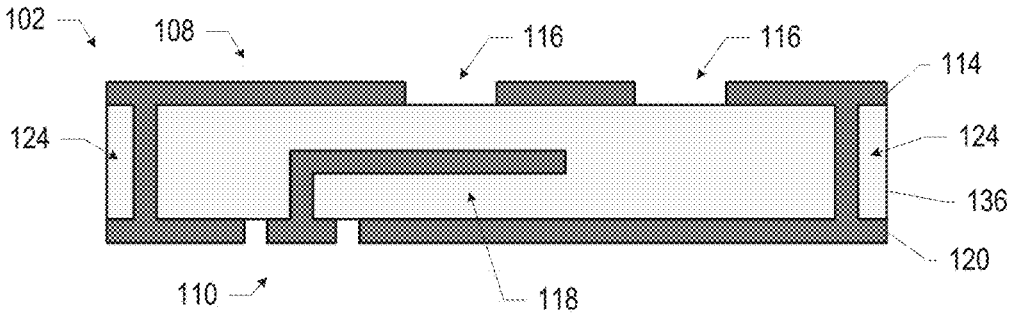
FIG. 3 is a side, cross-sectional view of antenna feed substrate, in accordance with various embodiments.

FIG. 3 is a side, cross-sectional view of an antenna feed substrate 102, in accordance with various embodiments. The elements of the antenna feed substrate 102 may be included in any of the antenna feed substrates 102 disclosed herein (e.g., in any of the antenna boards 100 disclosed herein). The antenna feed substrate 102 of FIG. 3 may include a bottom face 110 at which a ground plane 120 is disposed; the ground plane 120 may be coupled to a reference ground during operation. Although the ground plane 120 is shown as disposed at the bottom face 110 of the antenna feed substrate 102, the antenna feed substrate 102 may include more layers and structures "below" the ground plane 120; the ground plane 120 is shown at the bottom face 110 for ease of illustration in various ones of the accompanying figures, but other metal layers may be present between the ground plane 120 and the physical bottom face 110 of the antenna feed substrate 102. A feed structure 118 may extend from the bottom face 110 into the interior of the antenna feed substrate 102; the feed structure 118 may be driven by electromagnetic signals during operation. In the embodiment illustrated in FIG. 3, the feed structure 118 may be a stripline feed structure, but any suitable feed structure may be used. A ground plane 114 including apertures 116 therein may be disposed at the top face 108 of the antenna feed substrate 102; the ground plane 114 may be coupled to a reference ground during operation. Shield posts 124, which may include one or more vias in the antenna feed substrate 102, may be disposed proximate to the edges of the antenna feed substrate 102 and may couple the ground planes 114 and 120 (e.g., as illustrated in FIG. 4) and may provide a Faraday cage around the feed structure 118.

The ground plane 120, the feed structure 118, the ground plane 114, and the shield posts 124 may all be formed of conductive material (e.g., a metal, such as copper), and a dielectric material 136 may insulate the conductive structures of the antenna feed substrate 102 from each other. Any suitable dielectric material 136 may be used (e.g., a laminate material). In some embodiments, the dielectric material 136 may be an insulating material of the package substrate, such as an organic dielectric material, a fire retardant grade 4 material (FR-4), bismaleimide triazine (BT) resin, polyimide materials, glass reinforced epoxy matrix materials, or low-k and ultra low-k dielectric (e.g., carbon-doped dielectrics, fluorine-doped dielectrics, porous dielectrics, and organic polymeric dielectrics).

Figure 5:
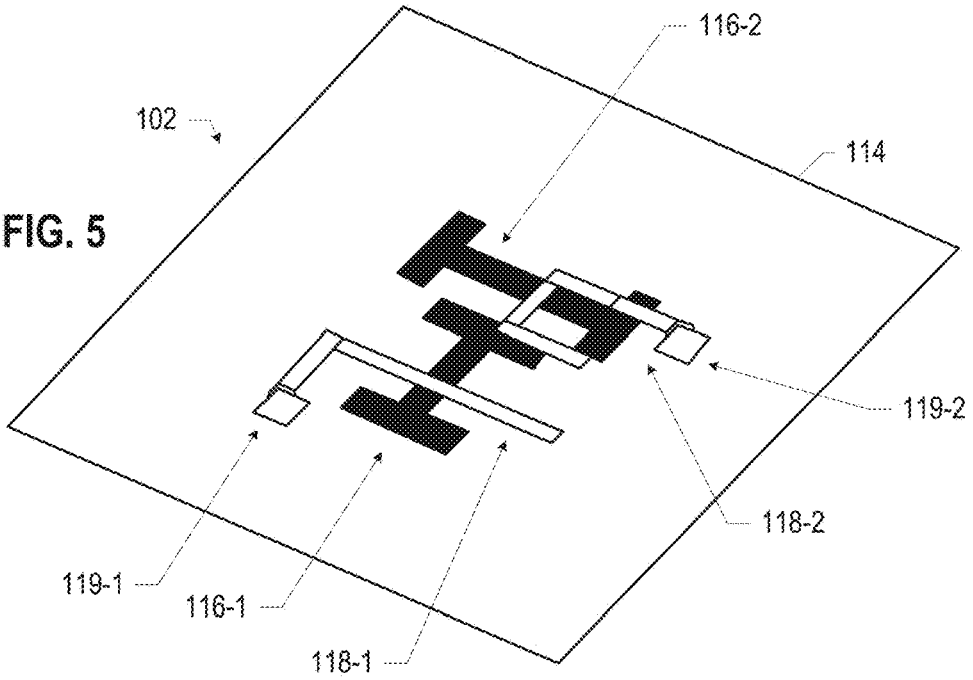
FIG. 5 is a bottom, perspective view of some components of an example antenna feed substrate, in accordance with various embodiments.
Figure 4:
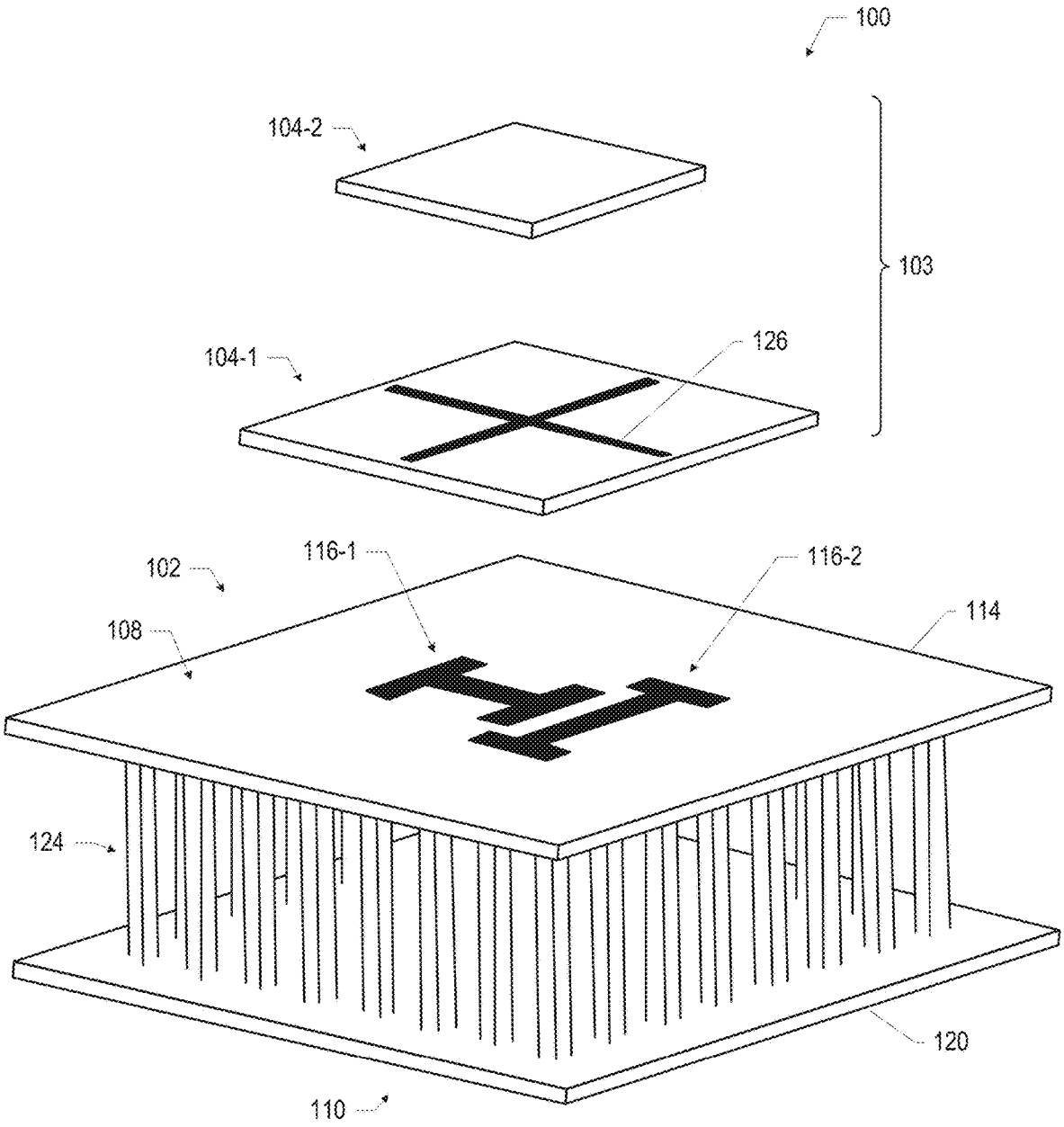
FIG. 4 is an exploded, perspective view of some components of an example antenna board, in accordance with various embodiments.

FIG. 4 is an exploded, perspective view of some components of an example antenna board 100, in accordance with various embodiments. In particular, FIG. 4 illustrates an embodiment of the antenna feed substrate 102 of FIG. 3, including a ground plane 120, shield posts 124, a ground plane 114, and apertures 116 in the ground plane 114. The feed structure 118 is omitted from FIG. 4 for ease of illustration, but an example of a feed structure 118 is illustrated in FIG. 5 and discussed below. FIG. 4 illustrates an embodiment in which two I-shaped apertures, 116-1 and 116-2, are included in the ground plane 114 and are arranged at right-angles relative to each other. FIG. 4 also illustrates two antenna patches, 104-1 and 104-2; an air cavity 112 may be disposed between the antenna feed substrate 102 and the antenna patch 104-1 (as illustrated in FIGS. 1 and 2). In some embodiments, a patch board 106 (not shown) may be disposed between the antenna patch 104-1 and the antenna patch 104-2 of FIG. 4, as discussed above with reference to FIG. 1, while in other embodiments, an air cavity 112 (not shown) may be disposed between the antenna patch 104-1 and the antenna patch 104-2 of FIG. 4, as discussed above with reference to FIG. 2. During operation, the apertures 116 may electromagnetically excite the antenna patches 104-1 and 104-2 for dual polarization, with the dual polarizations well isolated from each other. The apertures 116 may also be tuned to their resonances, contributing to the wideband characteristic of the impedance bandwidth of the antenna board 100. Having an air cavity 112 positioned between the apertures 116 and the antenna patch 104-1 (e.g., as discussed above with reference to FIGS. 1 and 2) may enable the apertures 116 to resonate efficiently.

The antenna patch 104-1 of FIG. 4 may have an aperture 126 disposed therein; the aperture 126 may extend through the thickness of the antenna patch 104-1. In some embodiments, as illustrated in FIG. 4, the aperture 126 may have a cross shape; the cross-shaped aperture 126 may be centered above the arrangement of I-shaped apertures 116 in the ground plane 114. In the embodiment of FIG. 4, the antenna patch 104-2 may have a footprint that is smaller than a footprint of the antenna patch 104-1 (as shown), and the antenna patch 104-2 may not have an aperture therein. The antenna patches 104-1 and 104-2 of FIG. 4 may be included in any of the antenna boards 100 disclosed herein. The antenna board 100 of FIG. 4 may thus be referred to as an aperture-fed stacked patch design (and may include one or more air cavities 112, as discussed above). In some embodiments, the dimensions of the structure in FIG. 4 may be approximately 4 millimeters by 4 millimeters by 1 millimeter.

FIG. 5 is a bottom, perspective view of some components of an example antenna feed substrate 102, in accordance with various embodiments. In particular, FIG. 5 illustrates an embodiment of the antenna feed substrate 102 of FIG. 3, including the ground plane 114, apertures 116-1 and 116-2 (as discussed above with reference to FIG. 4), and two feed structures 118-1 and 118-2. The pads 119-1 and 119-2 of the feed structures 118-1 and 118-2, respectively, may be coplanar with the ground plane 120 (not shown). The shield posts 124 are also omitted from FIG. 5 for ease of illustration. The feed structures 118-1 and 118-2 of FIG. 5 may be microstrip-line feed structures, and may be included in any of the antenna feed substrates 102 disclosed herein.

Figure 6:
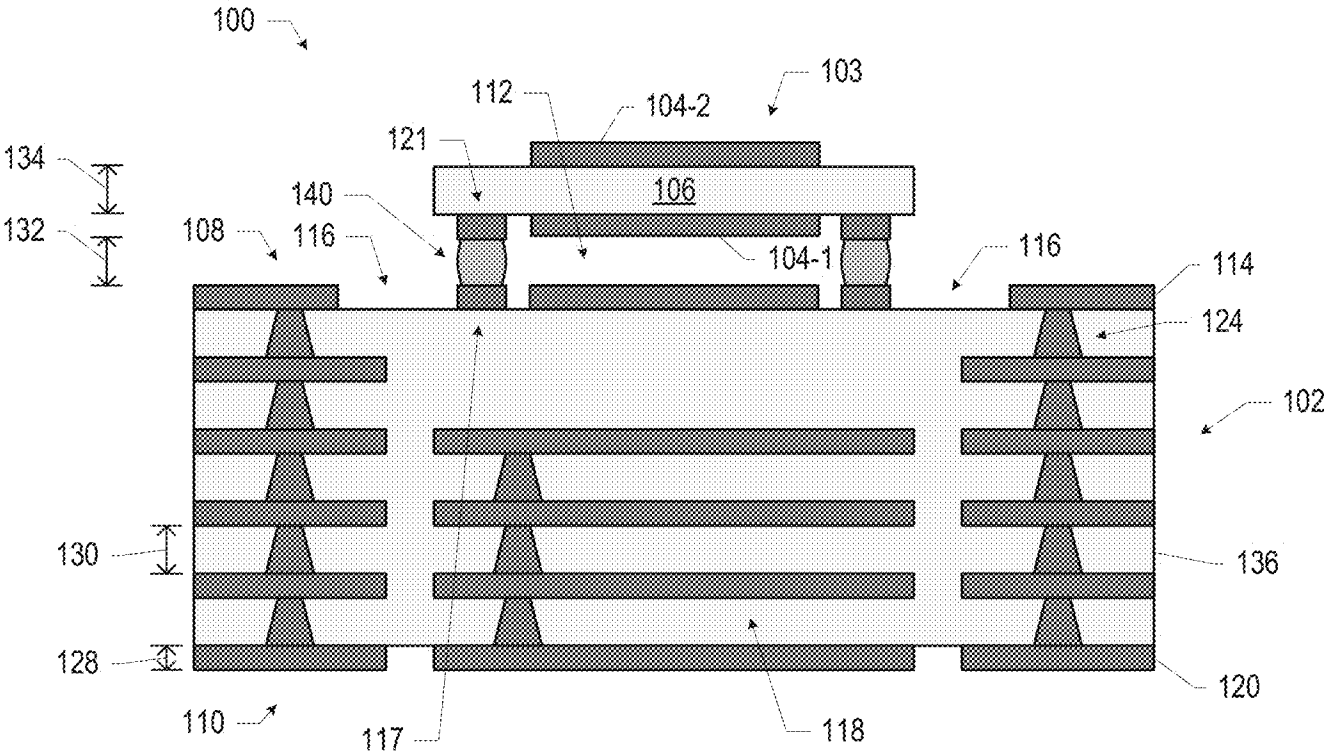
FIGS. 6-11 are views of example antenna boards, in accordance with various embodiments.

In some embodiments, an antenna board 100 may include an antenna patch 104 coupled to an antenna feed substrate 102 by solder. For example, FIG. 6 illustrates an antenna board 100 in which the antenna feed substrate 102 (e.g., including between two and eight PCB layers) includes conductive contacts 117 at the top face 108; other materials, such as a solder resist, may be present but are not shown. As used herein, a "conductive contact" may refer to a portion of conductive material (e.g., metal) serving as an electrical interface between different components; conductive contacts may be recessed in, flush with, or extending away from a surface of a component, and may take any suitable form (e.g., a conductive pad or socket). The antenna board 100 of FIG. 6 (and the antenna boards 100 of FIGS. 3 and 8-11) may include conductive contacts (not shown) at the bottom face 110 to which other components, such as the IC package 115 discussed below, may couple. The antenna feed substrate 102 of FIG. 6 may take the form of the antenna feed substrate 102 of FIG. 3. The antenna patches 104-1 and 104-2 may be coupled to (e.g., glued, soldered, or printed on) opposite faces of a patch board 106 (e.g., a PCB), and the patch board 106 may be secured to the antenna feed substrate 102 by solder 140 (or other second-level interconnects) between conductive contacts 121 of the patch board 106 and the conductive contacts 117 of the antenna feed substrate 102. The antenna board 100 of FIG. 6 is thus an embodiment of the antenna board 100 of FIG. 1. In some embodiments, the conductive contacts 117/solder 140 may provide an electrically conductive material pathway through which signals may be transmitted to or from the antenna patch 104-1. In other embodiments, the conductive contacts 117/solder 140 may be used only for mechanical coupling between the antenna patches 104 and the antenna feed substrate 102. The height of the solder 140 (or other interconnects) may control the distance between the antenna patch 104-1 and the top face 108 of the antenna feed substrate 102, while the thickness of the patch board 106 may control the distance between the antenna patches 104-1 and 104-2. The height of the solder 140 may be controlled with high accuracy (e.g., between 100 microns and 500 microns).

The dimensions of the components of the antenna board 100 of FIG. 6 may take any suitable values (e.g., any of the values disclosed herein). In some embodiments, the distance 132 between the top face 108 of the antenna feed substrate 102 and the antenna patch 104-1 (equal to the thickness of the air cavity 112) may be between 75 microns and 200 microns (e.g., between 100 microns and 150 microns, or approximately 120 microns). In some embodiments, the thickness 128 of a metal layer in the antenna feed substrate 102 may be between 5 microns and 50 microns (e.g., between 5 microns and 20 microns, between 10 microns and 20 microns, or approximately 15 microns). In some embodiments, the thickness 130 of a dielectric material between adjacent metal layers in the antenna feed substrate 102 may be between 50 microns and 200 microns (e.g., between 60 microns and 100 microns, between 70 microns and 110 microns, approximately 80 microns, approximately 90 microns, or approximately 100 microns). In some embodiments, the distance 134 between the antenna patch 104-1 and the antenna patch 104-2 (equal to the thickness of the patch board 106 in FIG. 6) may be between 50 microns and 200 microns (e.g., between 100 microns and 150 microns, or approximately 120 microns).

Figure 7:
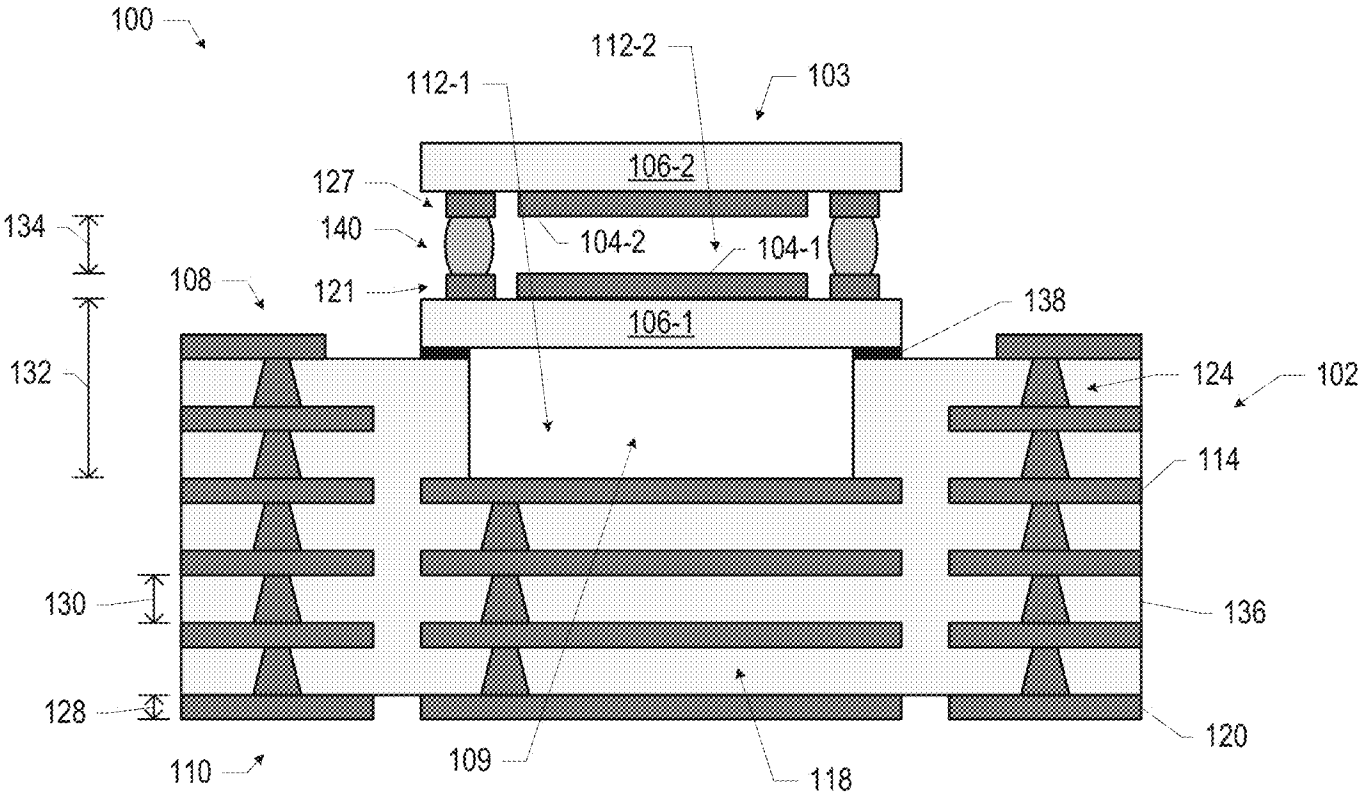

In some embodiments, an antenna board 100 may include an antenna patch 104 coupled to an antenna feed substrate 102 by an adhesive. FIG. 7 illustrates an antenna board 100 in which the antenna patch 104-1 is coupled to (e.g., glued, soldered, or printed on) a patch board 106-1, the antenna patch 104-2 is coupled to a patch board 106-1, the patch board 106-1 is coupled to an adhesive 138 at the top face 108 of the antenna feed substrate 102, and the patch board 106-1 is coupled to the patch board 106-2 by solder 140 (e.g., solder 140 coupling conductive contacts 121 of the patch board 106-1 to conductive contacts 127 of the patch board 106-2). The antenna board 100 of FIG. 7 is thus an embodiment of the antenna board 100 of FIG. 2. Further, the antenna feed substrate 102 may have a recess 109 that at least partially provides the air cavity 112-1 between the antenna feed substrate 102 and the antenna patch 104-2; the thickness of the adhesive 138 accounts for the rest of the thickness of the air gap 112-1. The height of the solder 140 may control the distance between the antenna patch 104-1 and the antenna patch 104-2, and thus the thickness of the air gap 112-2. The adhesive 138 may be electrically non-conductive, and thus the antenna patches 104 may not be electrically coupled to the antenna feed substrate 102 by an electrically conductive material pathway. In some embodiments, the adhesive 138 may be an epoxy. The dimensions of the components of the antenna board 100 of FIG. 7 may take any suitable values (e.g., any of the values disclosed herein). For example, the distance 132 may be between 100 microns and 500 microns (e.g., between 200 microns and 400 microns).

Figure 8:
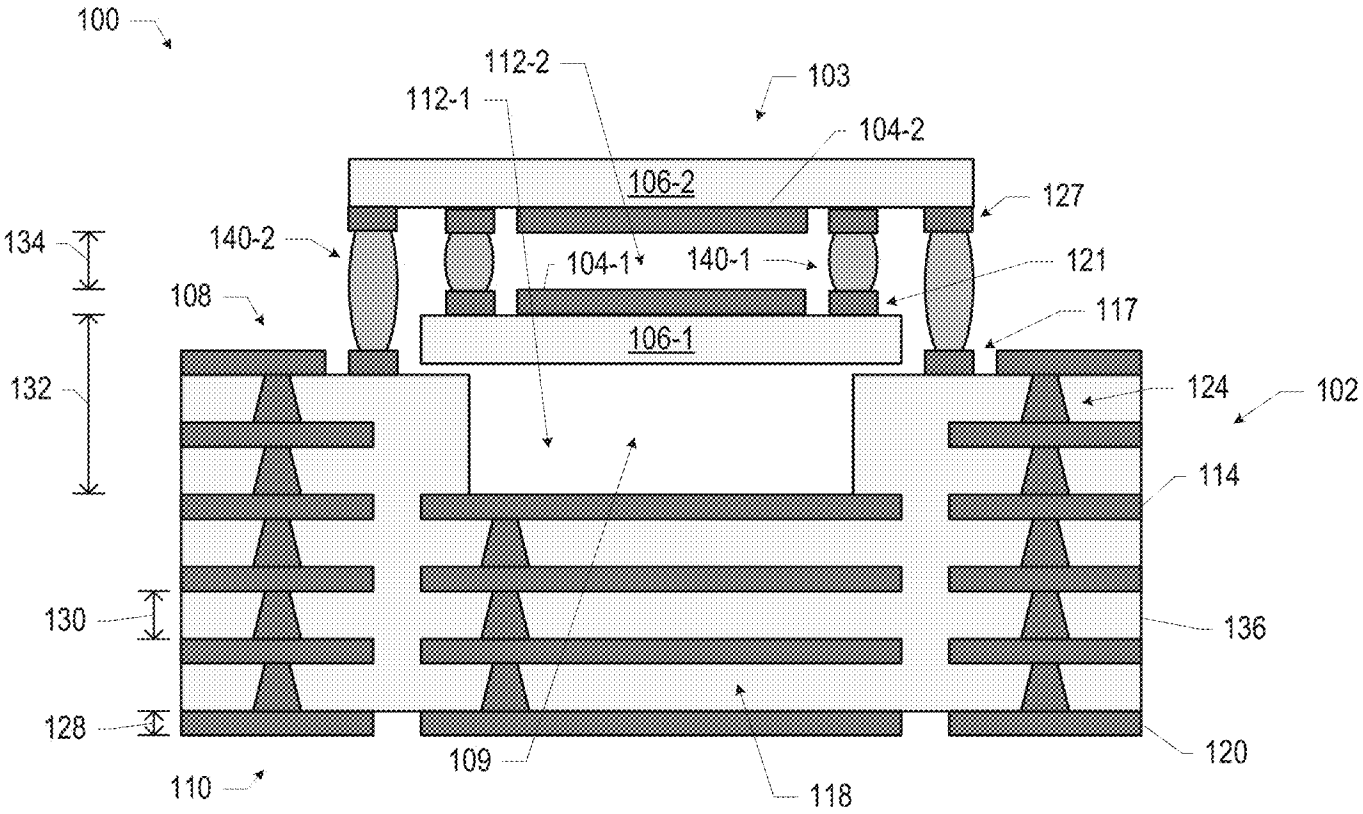

FIG. 8 illustrates an antenna board 100 having a structure similar to that of FIG. 7, but in which the patch board 106-1 (to which the antenna patch 104-1 is coupled) is coupled to the patch board 106-2 (to which the antenna patch 104-2 is coupled) by solder 140-1 (e.g., solder 140-1 coupling conductive contacts 121 of the patch board 106-1 to conductive contacts 127 of the patch board 106-2), and the patch board 106-2 is coupled to the antenna feed substrate 102 by solder 140-2 (e.g., solder 140-2 coupling conductive contacts 127 of the patch board 106-2 to conductive contacts 117 of the antenna feed substrate 102). An air cavity 112-1 may be present between the antenna feed substrate 102 and the antenna patch 104-1, and an air cavity 112-2 may be present between the antenna patch 104-1 and the antenna patch 104-2. The antenna board 100 of FIG. 8 is thus an embodiment of the antenna board 100 of FIG. 2. The relative distance between the antenna patches 104-1 and 104-2 may be controlled at least partially by the height of the solder 140-1, while the distance of the antenna patches 104-1 and 104-2 from the antenna feed substrate 102 may be controlled at least partially by the height of the solder 140-2. The dimensions of the components of the antenna board 100 of FIG. 8 may take any suitable values (e.g., any of the values disclosed herein).

Figure 9:
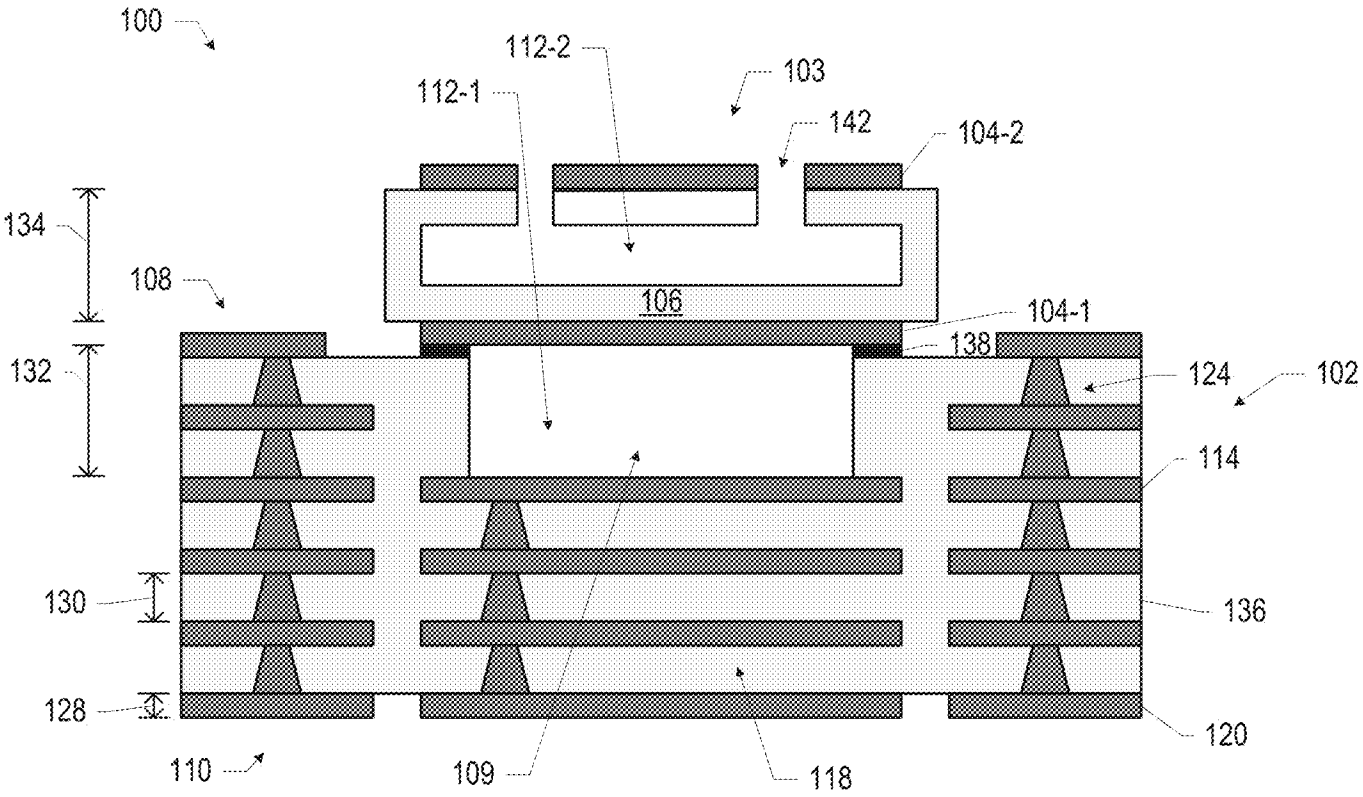

A patch board 106 may take any suitable form. For example, FIG. 9 illustrates an antenna board 100 including a patch board 106 that has an air cavity 112-2 therein; the antenna patch 104-1 may be coupled to the antenna feed substrate 102 by an adhesive 138 (e.g., as discussed above with reference to FIG. 7), the antenna patch 104-1 may also be coupled to a bottom face of the patch board 106, and the antenna patch 104-2 may be coupled to a top face of the patch board 106 so that multiple layers of the patch board 106, and the air cavity 112-2, are disposed between the antenna patches 104-1 and 104-2. An air cavity 112-1 may be present between the antenna feed substrate 102 and the antenna patch 104-1, and an air cavity 112-2 may be present between the antenna patch 104-1 and the antenna patch 104-2. The antenna board 100 of FIG. 9 is thus an example of the antenna board 100 of FIG. 1, and an example of the antenna board 100 of FIG. 2. In some embodiments, the top face of the patch board 106 may include openings 142 to act as vent holes between the air cavity 112-2 and the external environment. Any suitable technique may be used to manufacture a patch board 106 like the patch board 106 illustrated in FIG. 9; an example process flow is illustrated in FIG. 12 and discussed below. The dimensions of the components of the antenna board 100 of FIG. 9 may take any suitable values (e.g., any of the values disclosed herein). For example, the distance 134 may be between 100 microns and 500 microns (e.g., between 200 microns and 400 microns).

Figure 10:
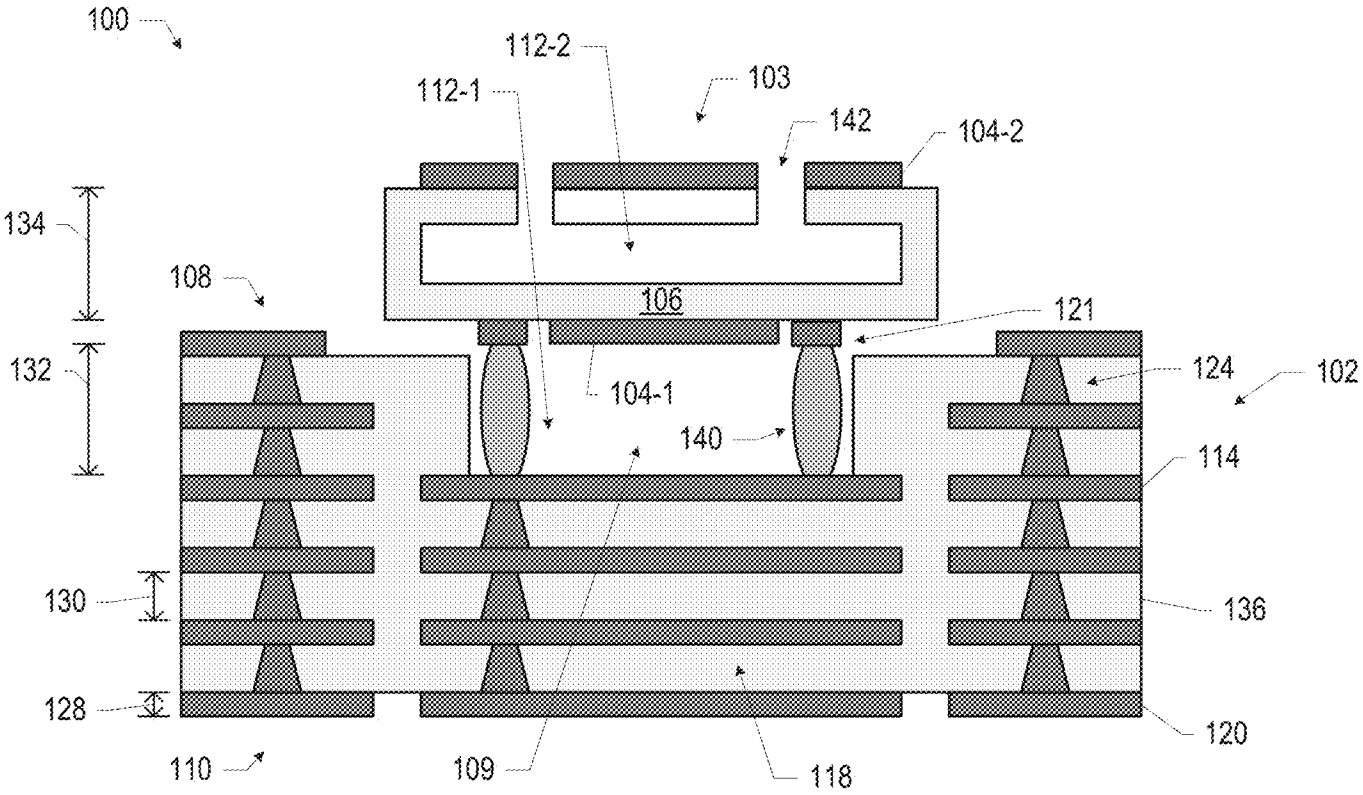

FIG. 10 illustrates an antenna board 100 having a structure similar to that of FIG. 9, but in which the patch board 106 is coupled to the antenna feed substrate 102 by solder 140 (and thus the solder 140 may control the distance 132); like FIG. 9, the antenna patches 104-1 and 104-2 are coupled to opposite faces of the patch board 106 of FIG. 9. An air cavity 112-1 may be present between the antenna feed substrate 102 and the antenna patch 104-1, and an air cavity 112-2 may be present between the antenna patch 104-1 and the antenna patch 104-2. The antenna board 100 of FIG. 9 is thus an example of the antenna board 100 of FIG. 1, and an example of the antenna board 100 of FIG. 2. In some embodiments, the top face of the patch board 106 may include openings 142 to act as vent holes between the air cavity 112-2 and the external environment. The dimensions of the components of the antenna board 100 of FIG. 10 may take any suitable values (e.g., any of the values disclosed herein).

As noted above, an antenna board 100 may include a stack 103 having more than two antenna patches 104. For example, FIG. 11 illustrates an antenna board 100 having a structure similar to that of FIG. 9, but in which a third antenna patch, 104-3, is coupled to the antenna patch 104-2 by solder 140. An air cavity 112-1 may be present between the antenna feed substrate 102 and the antenna patch 104-1, an air cavity 112-2 may be present between the antenna patch 104-1 and the antenna patch 104-2, and an air cavity 112-3 may be present between the antenna patch 104-2 and the antenna patch 104-3. Further antenna patches 104 may be included in a stack 103 (e.g., by including patch boards 106 like the patch boards 106 illustrated in FIGS. 6-11). The dimensions of the components of the antenna board 100 of FIG. 11 may take any suitable values (e.g., any of the values disclosed herein).

The antenna feed substrates 102 and patch boards 106 disclosed herein may be manufactured using any suitable techniques. For example, FIGS. 12A-12D illustrate various stages in the manufacture of the patch board 106 of FIG. 9 (and FIGS. 10-11), in accordance with various embodiments. Although the operations of FIG. 12 may be illustrated with reference to particular embodiments of the patch boards 106 disclosed herein, these operations may be used to manufacture any suitable patch boards 106. Operations are illustrated once each and in a particular order in FIG. 12, but the operations may be reordered and/or repeated as desired (e.g., with different operations performed in parallel when manufacturing multiple patch boards 106 simultaneously).

Figure 12A:
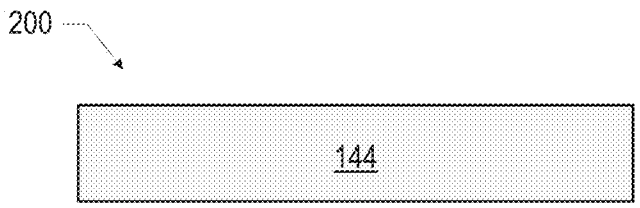
FIGS. 12A-12D illustrate various stages in the manufacture of the patch board of FIG. 9, in accordance with various embodiments.

FIG. 12A is a side, cross-sectional view of an assembly 200 including a first patch board portion 144. The first patch board portion 144 may be a PCB, a plastic component, or may include any suitable material.

Figure 12B:
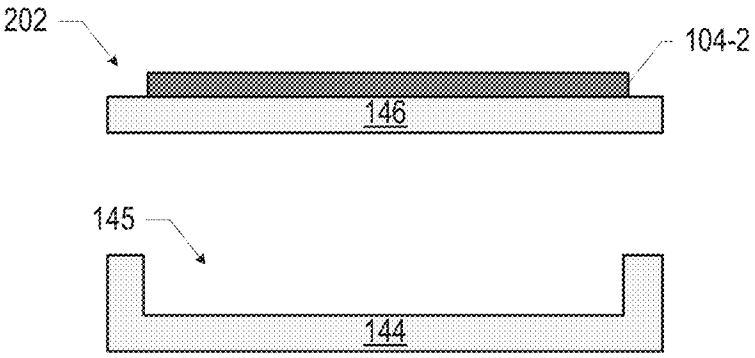

FIG. 12B is a side, cross-sectional view of an assembly 202 subsequent to forming a recess 145 in the first patch board portion 144 of the assembly 200 (FIG. 12A), and then bringing a second patch board portion 146 into proximity with the first patch board portion 144. In some embodiments, the recess 145 may be formed by mechanical drilling (e.g., landing on a metal plane when the first patch board portion 144 is a PCB). In some embodiments, the first patch board portion 144 may be manufactured (e.g., by three-dimensional printing) in the form illustrated in FIG. 12B, and thus no recess 145 need be separately formed. The second patch board portion 146 may have the antenna patch 104-2 coupled to its face, as shown (or the antenna patch 104-2 may be added in a later operation).

Figure 12C:
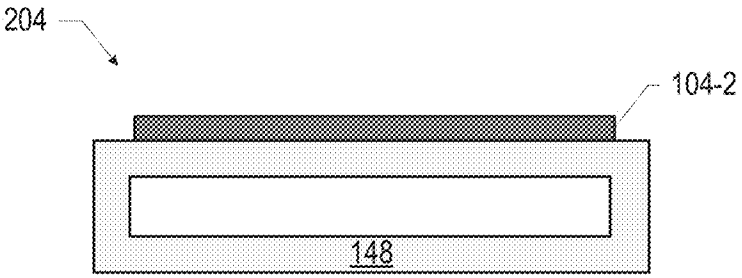

FIG. 12C is a side, cross-sectional view of an assembly 204 subsequent to coupling the second patch board portion 146 and the first patch board portion 144 of the assembly 202 (FIG. 12B) together. The coupling of the second patch board portion 146 and the first patch board portion 144 may be performed using any suitable technique (e.g., gluing, soldering, etc.).

Figure 12D:
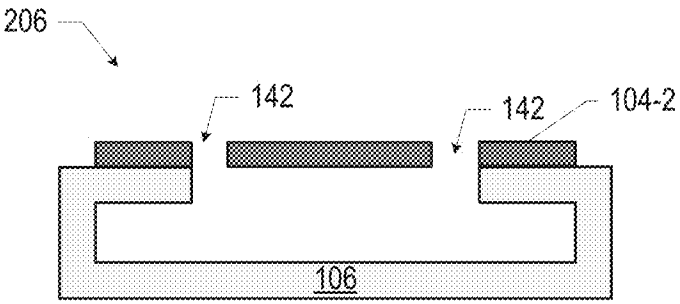

FIG. 12D is a side, cross-sectional view of an assembly 206 subsequent to forming openings 142 in the antenna patch 104-2 and the second patch board portion 146 of the assembly 204 (FIG. 12C) to form the patch board 106. The openings 142 may provide an air hole for venting the interior of the patch board 106.

Figure 13:
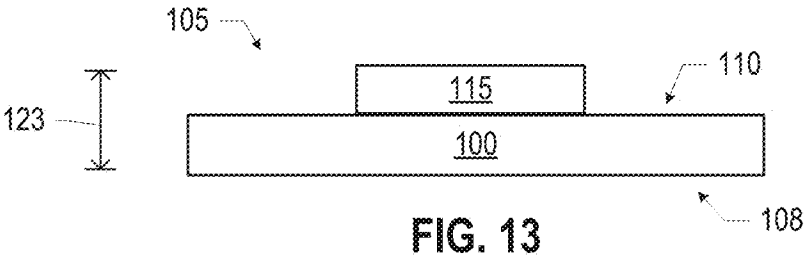
FIG. 13 is a side, cross-sectional view of an antenna module, in accordance with various embodiments.

In some embodiments, an antenna board 100 may be part of an antenna module. For example, FIG. 13 is a side, cross-sectional view of an antenna module 105, in accordance with various embodiments. The antenna module 105 may include an IC package 115 coupled to an antenna board 100. Although a single IC package 115 is illustrated in FIG. 1, an antenna module 105 may include more than one IC package 115. As noted above, the antenna board 100 may include an antenna feed substrate 102 (not shown in FIG. 13) having conductive pathways (e.g., provided by conductive vias and lines through one or more dielectric materials) and RF transmission structures (e.g., antenna feed structures, such as the antenna feed structure 118) that may enable one or more antenna patches 104 (not shown in FIG. 13) to transmit and receive electromagnetic waves under the control of circuitry in the IC package 115. In some embodiments, the IC package 115 may be coupled to the antenna board 100 by second-level interconnects (not shown, but discussed below with reference to FIG. 14). In some embodiments, an antenna module 105 may include a different IC package 115 for controlling each different antenna patch 104; in other embodiments, an antenna module 105 may include one IC package 115 having circuitry to control multiple antenna patches 104. In some embodiments, the total z-height 123 of an antenna module 105 may be less than 3 millimeters (e.g., between 2 millimeters and 3 millimeters).

In some embodiments, an antenna board 100 and/or an antenna module 105 may include one or more arrays of antenna patches 104 to support multiple communication bands (e.g., dual band operation or tri-band operation). For example, some of the antenna boards 100 and/or antenna modules 105 disclosed herein may support tri-band operation at 28 gigahertz, 39 gigahertz, and 60 gigahertz. Various ones of the antenna boards 100 and/or antenna modules 105 disclosed herein may support tri-band operation at 24.5 gigahertz to 29 gigahertz, 37 gigahertz to 43 gigahertz, and 57 gigahertz to 71 gigahertz. Various ones of the antenna boards 100 and/or antenna modules 105 disclosed herein may support 5G communications and 60 gigahertz communications. Various ones of the antenna boards 100 and/or antenna modules 105 disclosed herein may support 28 gigahertz and 39 gigahertz communications. Various of the antenna boards 100 and/or antenna modules 105 disclosed herein may support millimeter wave communications. Various of the antenna boards 10 and/or antenna modules 105 disclosed herein may support high band frequencies and low band frequencies.

Figure 14:
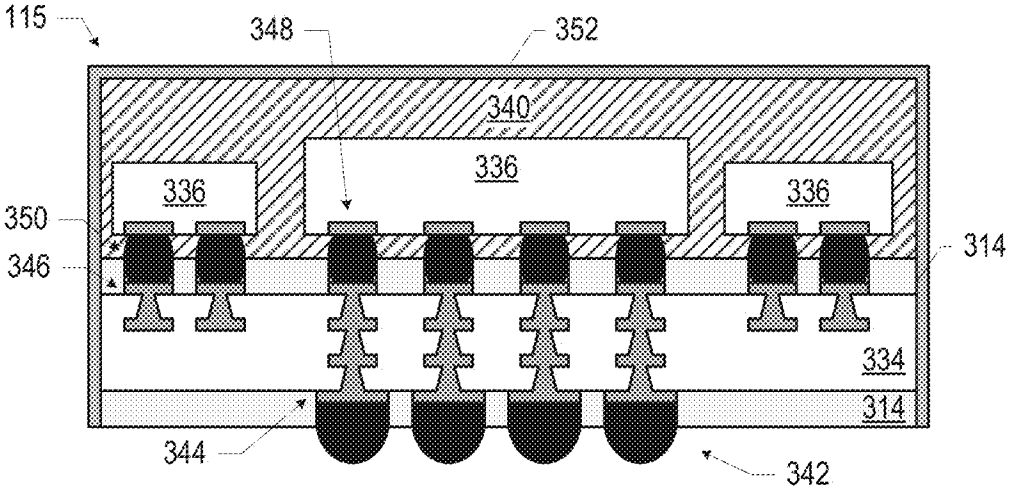
FIG. 14 is a side, cross-sectional view of an integrated circuit (IC) package that may be included in an antenna module, in accordance with various embodiments.

The IC package 115 included in an antenna module may have any suitable structure. For example, FIG. 14 illustrates an example IC package 115 that may be included in an antenna module 105. The IC package 115 may include a package substrate 334 to which one or more components 336 may be coupled by first-level interconnects 350. In particular, conductive contacts at one face of the package substrate 334 may be coupled to conductive contacts 348 at faces of the components 336 by first-level interconnects 350. The first-level interconnects 350 illustrated in FIG. 14 are solder bumps, but any suitable first-level interconnects 350 may be used. A solder resist 314 may be disposed around the conductive contacts 346. The package substrate 334 may include a dielectric material, and may have conductive pathways (e.g., including conductive vias and lines) extending through the dielectric material between the faces, or between different locations on each face. In some embodiments, the package substrate 334 may have a thickness less than 1 millimeter (e.g., between 0.1 millimeters and 0.5 millimeters). Conductive contacts 344 may be disposed at the other face of the package substrate 334, and second-level interconnects 342 may couple these conductive contacts 344 to the antenna board 100 (not shown) in an antenna module 105. The second-level interconnects 342 illustrated in FIG. 14 are solder balls (e.g., for a ball grid array arrangement), but any suitable second-level interconnects 342 may be used (e.g., pins in a pin grid array arrangement or lands in a land grid array arrangement). A solder resist 314 may be disposed around the conductive contacts 344. In some embodiments, a mold material 340 may be disposed around the components 336 (e.g., between the components 336 and the package substrate 334 as an underfill material). In some embodiments, a thickness of the mold material may be less than 1 millimeter. Example materials that may be used for the mold material 340 include epoxy mold materials, as suitable. In some embodiments, a conformal shield 352 may be disposed around the components 336 and the package substrate 334 to provide electromagnetic shielding for the IC package 115.

The components 336 may include any suitable IC components. In some embodiments, one or more of the components 336 may include a die. For example, one or more of the components 336 may be a RF communication die. In some embodiments, one or more of the components 336 may include a resistor, capacitor (e.g., decoupling capacitors), inductor, DC-DC converter circuitry, or other circuit elements. In some embodiments, the IC package 115 may be a system-in-package (SiP). In some embodiments, the IC package 115 may be a flip chip (FC) chip scale package (CSP). In some embodiments, one or more of the components 336 may include a memory device programmed with instructions to execute beam forming, scanning, and/or codebook functions.

Figure 15:
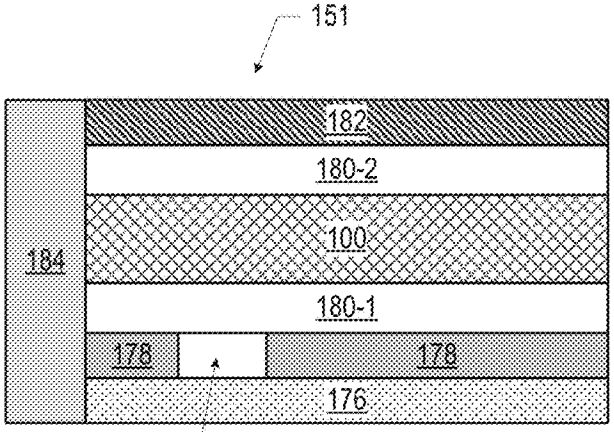
FIG. 15 is a side, cross-sectional view of a portion of a communication device including an antenna module, in accordance with various embodiments.

The antenna boards 100 and antenna modules 105 disclosed herein may be included in any suitable communication device (e.g., a computing device with wireless communication capability, a wearable device with wireless communication circuitry, etc.). FIG. 15 is a side, cross-sectional view of a portion of a communication device 151 including an antenna board 100 (which may be part of an antenna module 105), in accordance with various embodiments. In particular, the communication device 151 illustrated in FIG. 15 may be a handheld communication device, such as a smart phone or tablet. The communication device 151 may include a glass or plastic back cover 176 proximate to a metallic or plastic chassis 178. In some embodiments, the chassis 178 may be laminated onto the back cover 176, or attached to the back cover 176 with an adhesive. The chassis 178 may include one or more openings 179 that align with antenna patches 104 (not shown) of the antenna board 100 to improve performance. An air gap 180-1 may space at least some of the antenna board 100 from the chassis 178, and another air gap 180-2 may be located on the other side of the antenna board 100. In some embodiments, the spacing between the antenna patches 104 and the back cover 176 may be selected and controlled within tens of microns to achieve desired performance. The air gap 180-2 may separate the antenna board 100 from a display 182 on the front side of the communication device 151; in some embodiments, the display 182 may have a metal layer proximate to the air gap 180-2 to draw heat away from the display 182. A metal or plastic housing 184 may provide the "sides" of the communication device 151.

The antenna boards 100 and antenna modules 105 disclosed herein may include, or be included in, any suitable electronic component. FIGS. 16-19 illustrate various examples of apparatuses that may include, or may be included in, a communication device along with, any of the antenna boards 100 disclosed herein.

Figure 16:
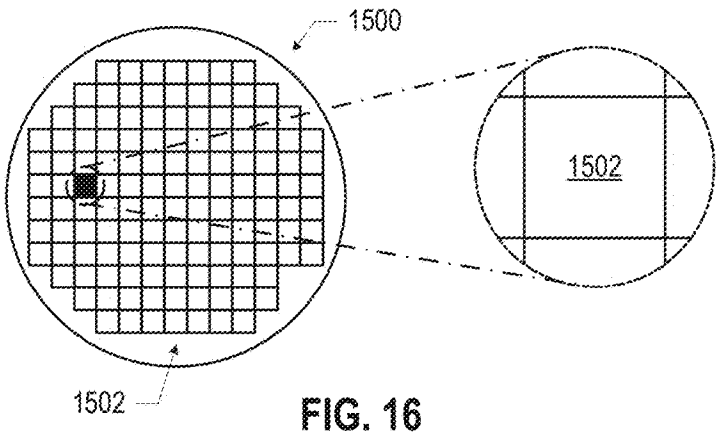
FIG. 16 is a top view of a wafer and dies that may be included in a communications device along with an antenna board, in accordance with any of the embodiments disclosed herein.

FIG. 16 is a top view of a wafer 1500 and dies 1502 that may be included in a communication device along with any of the antenna boards 100 disclosed herein. The wafer 1500 may be composed of semiconductor material and may include one or more dies 1502 having IC structures formed on a surface of the wafer 1500. Each of the dies 1502 may be a repeating unit of a semiconductor product that includes any suitable IC. After the fabrication of the semiconductor product is complete, the wafer 1500 may undergo a singulation process in which the dies 1502 are separated from one another to provide discrete "chips" of the semiconductor product. The die 1502 may include one or more transistors (e.g., some of the transistors 1640 of FIG. 17, discussed below) and/or supporting circuitry to route electrical signals to the transistors, as well as any other IC components. In some embodiments, the wafer 1500 or the die 1502 may include a memory device (e.g., a random access memory (RAM) device, such as a static RAM (SRAM) device, a magnetic RAM (MRAM) device, a resistive RAM (RRAM) device, a conductive-bridging RAM (CBRAM) device, etc.), a logic device (e.g., an AND, OR, NAND, or NOR gate), or any other suitable circuit element. Multiple ones of these devices may be combined on a single die 1502. For example, a memory array formed by multiple memory devices may be formed on a same die 1502 as a processing device (e.g., the processing device 1802 of FIG. 19) or other logic that is configured to store information in the memory devices or execute instructions stored in the memory array.

Figure 17:
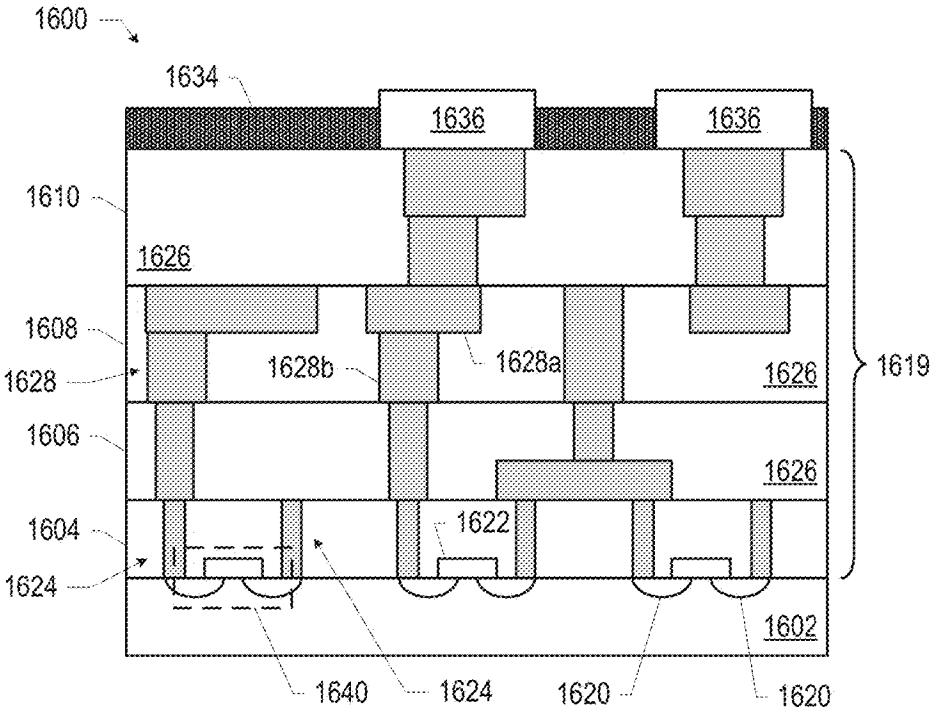
FIG. 17 is a side, cross-sectional view of an IC device that may be included in a communications device along with an antenna board, in accordance with any of the embodiments disclosed herein.

FIG. 17 is a side, cross-sectional view of an IC device 1600 that may be included in a communication device along with any of the antenna boards 100 disclosed herein. The IC device 1600 may be formed on a substrate 1602 (e.g., the wafer 1500 of FIG. 16) and may be included in a die (e.g., the die 1502 of FIG. 16). The substrate 1602 may be a semiconductor substrate composed of semiconductor material systems including, for example, n-type or p-type materials systems (or a combination of both). The substrate 1602 may include, for example, a crystalline substrate formed using a bulk silicon or a silicon-on-insulator (SOI) substructure. In some embodiments, the substrate 1602 may be formed using alternative materials, which may or may not be combined with silicon, that include but are not limited to germanium, indium antimonide, lead telluride, indium arsenide, indium phosphide, gallium arsenide, or gallium antimonide. Further materials classified as group II-VI, III-V, or IV may also be used to form the substrate 1602. Although a few examples of materials from which the substrate 1602 may be formed are described here, any material that may serve as a foundation for an IC device 1600 may be used. The substrate 1602 may be part of a singulated die (e.g., the dies 1502 of FIG. 16) or a wafer (e.g., the wafer 1500 of FIG. 16).

The IC device 1600 may include one or more device layers 1604 disposed on the substrate 1602. The device layer 1604 may include features of one or more transistors 1640 (e.g., metal oxide semiconductor field-effect transistors (MOSFETs)) formed on the substrate 1602. The device layer 1604 may include, for example, one or more source and/or drain (S/D) regions 1620, a gate 1622 to control current flow in the transistors 1640 between the S/D regions 1620, and one or more S/D contacts 1624 to route electrical signals to/from the S/D regions 1620. The transistors 1640 may include additional features not depicted for the sake of clarity, such as device isolation regions, gate contacts, and the like. The transistors 1640 are not limited to the type and configuration depicted in FIG. 17 and may include a wide variety of other types and configurations such as, for example, planar transistors, non-planar transistors, or a combination of both. Planar transistors may include bipolar junction transistors (BJT), heterojunction bipolar transistors (HBT), or high-electron-mobility transistors (HEMT). Non-planar transistors may include FinFET transistors, such as double-gate transistors or tri-gate transistors, and wrap-around or all-around gate transistors, such as nanoribbon and nanowire transistors.

Each transistor 1640 may include a gate 1622 formed of at least two layers, a gate dielectric and a gate electrode. The gate dielectric may include one layer or a stack of layers. The one or more layers may include silicon oxide, silicon dioxide, silicon carbide, and/or a high-k dielectric material. The high-k dielectric material may include elements such as hafnium, silicon, oxygen, titanium, tantalum, lanthanum, aluminum, zirconium, barium, strontium, yttrium, lead, scandium, niobium, and zinc. Examples of high-k materials that may be used in the gate dielectric include, but are not limited to, hafnium oxide, hafnium silicon oxide, lanthanum oxide, lanthanum aluminum oxide, zirconium oxide, zirconium silicon oxide, tantalum oxide, titanium oxide, barium strontium titanium oxide, barium titanium oxide, strontium titanium oxide, yttrium oxide, aluminum oxide, lead scandium tantalum oxide, and lead zinc niobate. In some embodiments, an annealing process may be carried out on the gate dielectric to improve its quality when a high-k material is used.

The gate electrode may be formed on the gate dielectric and may include at least one p-type work function metal or n-type work function metal, depending on whether the transistor 1640 is to be a p-type metal oxide semiconductor (PMOS) or an n-type metal oxide semiconductor (NMOS) transistor. In some implementations, the gate electrode may consist of a stack of two or more metal layers, where one or more metal layers are work function metal layers and at least one metal layer is a fill metal layer. Further metal layers may be included for other purposes, such as a barrier layer. For a PMOS transistor, metals that may be used for the gate electrode include, but are not limited to, ruthenium, palladium, platinum, cobalt, nickel, conductive metal oxides (e.g., ruthenium oxide), and any of the metals discussed below with reference to an NMOS transistor (e.g., for work function tuning). For an NMOS transistor, metals that may be used for the gate electrode include, but are not limited to, hafnium, zirconium, titanium, tantalum, aluminum, alloys of these metals, carbides of these metals (e.g., hafnium carbide, zirconium carbide, titanium carbide, tantalum carbide, and aluminum carbide), and any of the metals discussed above with reference to a PMOS transistor (e.g., for work function tuning).

In some embodiments, when viewed as a cross-section of the transistor 1640 along the source-channel-drain direction, the gate electrode may consist of a U-shaped structure that includes a bottom portion substantially parallel to the surface of the substrate and two sidewall portions that are substantially perpendicular to the top surface of the substrate. In other embodiments, at least one of the metal layers that form the gate electrode may simply be a planar layer that is substantially parallel to the top surface of the substrate and does not include sidewall portions substantially perpendicular to the top surface of the substrate. In other embodiments, the gate electrode may consist of a combination of U-shaped structures and planar, non-U-shaped structures. For example, the gate electrode may consist of one or more U-shaped metal layers formed atop one or more planar, non-U-shaped layers.

In some embodiments, a pair of sidewall spacers may be formed on opposing sides of the gate stack to bracket the gate stack. The sidewall spacers may be formed from materials such as silicon nitride, silicon oxide, silicon carbide, silicon nitride doped with carbon, and silicon oxynitride. Processes for forming sidewall spacers are well known in the art and generally include deposition and etching process steps. In some embodiments, a plurality of spacer pairs may be used; for instance, two pairs, three pairs, or four pairs of sidewall spacers may be formed on opposing sides of the gate stack.

The S/D regions 1620 may be formed within the substrate 1602 adjacent to the gate 1622 of each transistor 1640. The S/D regions 1620 may be formed using an implantation/diffusion process or an etching/deposition process, for example. In the former process, dopants such as boron, aluminum, antimony, phosphorous, or arsenic may be ion-implanted into the substrate 1602 to form the S/D regions 1620. An annealing process that activates the dopants and causes them to diffuse farther into the substrate 1602 may follow the ion-implantation process. In the latter process, the substrate 1602 may first be etched to form recesses at the locations of the S/D regions 1620. An epitaxial deposition process may then be carried out to fill the recesses with material that is used to fabricate the S/D regions 1620. In some implementations, the S/D regions 1620 may be fabricated using a silicon alloy such as silicon germanium or silicon carbide. In some embodiments, the epitaxially deposited silicon alloy may be doped in situ with dopants such as boron, arsenic, or phosphorous. In some embodiments, the S/D regions 1620 may be formed using one or more alternate semiconductor materials such as germanium or a group III-V material or alloy. In further embodiments, one or more layers of metal and/or metal alloys may be used to form the S/D regions 1620.

Electrical signals, such as power and/or input/output (I/O) signals, may be routed to and/or from the devices (e.g., the transistors 1640) of the device layer 1604 through one or more interconnect layers disposed on the device layer 1604 (illustrated in FIG. 17 as interconnect layers 1606-1610). For example, electrically conductive features of the device layer 1604 (e.g., the gate 1622 and the S/D contacts 1624) may be electrically coupled with the interconnect structures 1628 of the interconnect layers 1606-1610. The one or more interconnect layers 1606-1610 may form a metallization stack (also referred to as an "ILD stack") 1619 of the IC device 1600.

The interconnect structures 1628 may be arranged within the interconnect layers 1606-1610 to route electrical signals according to a wide variety of designs (in particular, the arrangement is not limited to the particular configuration of interconnect structures 1628 depicted in FIG. 17). Although a particular number of interconnect layers 1606-1610 is depicted in FIG. 17, embodiments of the present disclosure include IC devices having more or fewer interconnect layers than depicted.

In some embodiments, the interconnect structures 1628 may include lines 1628*a* and/or vias 1628*b* filled with an electrically conductive material such as a metal. The lines 1628*a* may be arranged to route electrical signals in a direction of a plane that is substantially parallel with a surface of the substrate 1602 upon which the device layer 1604 is formed. For example, the lines 1628*a* may route electrical signals in a direction in and out of the page from the perspective of FIG. 17. The vias 1628*b* may be arranged to route electrical signals in a direction of a plane that is substantially perpendicular to the surface of the substrate 1602 upon which the device layer 1604 is formed. In some embodiments, the vias 1628*b* may electrically couple lines 1628*a* of different interconnect layers 1606-1610 together.

The interconnect layers 1606-1610 may include a dielectric material 1626 disposed between the interconnect structures 1628, as shown in FIG. 17. In some embodiments, the dielectric material 1626 disposed between the interconnect structures 1628 in different ones of the interconnect layers 1606-1610 may have different compositions; in other embodiments, the composition of the dielectric material 1626 between different interconnect layers 1606-1610 may be the same.

A first interconnect layer 1606 may be formed above the device layer 1604. In some embodiments, the first interconnect layer 1606 may include lines 1628*a* and/or vias 1628*b*, as shown. The lines 1628*a* of the first interconnect layer 1606 may be coupled with contacts (e.g., the S/D contacts 1624) of the device layer 1604.

A second interconnect layer 1608 may be formed above the first interconnect layer 1606. In some embodiments, the second interconnect layer 1608 may include vias 1628*b* to couple the lines 1628*a* of the second interconnect layer 1608 with the lines 1628*a* of the first interconnect layer 1606. Although the lines 1628*a* and the vias 1628*b* are structurally delineated with a line within each interconnect layer (e.g., within the second interconnect layer 1608) for the sake of clarity, the lines 1628*a* and the vias 1628*b* may be structurally and/or materially contiguous (e.g., simultaneously filled during a dual-damascene process) in some embodiments.

A third interconnect layer 1610 (and additional interconnect layers, as desired) may be formed in succession on the second interconnect layer 1608 according to similar techniques and configurations described in connection with the second interconnect layer 1608 or the first interconnect layer 1606. In some embodiments, the interconnect layers that are "higher up" in the metallization stack 1619 in the IC device 1600 (i.e., farther away from the device layer 1604) may be thicker.

The IC device 1600 may include a solder resist material 1634 (e.g., polyimide or similar material) and one or more conductive contacts 1636 formed on the interconnect layers 1606-1610. In FIG. 17, the conductive contacts 1636 are illustrated as taking the form of bond pads. The conductive contacts 1636 may be electrically coupled with the interconnect structures 1628 and configured to route the electrical signals of the transistor(s) 1640 to other external devices. For example, solder bonds may be formed on the one or more conductive contacts 1636 to mechanically and/or electrically couple a chip including the IC device 1600 with another component (e.g., a circuit board). The IC device 1600 may include additional or alternate structures to route the electrical signals from the interconnect layers 1606-1610; for example, the conductive contacts 1636 may include other analogous features (e.g., posts) that route the electrical signals to external components.

Figure 18:
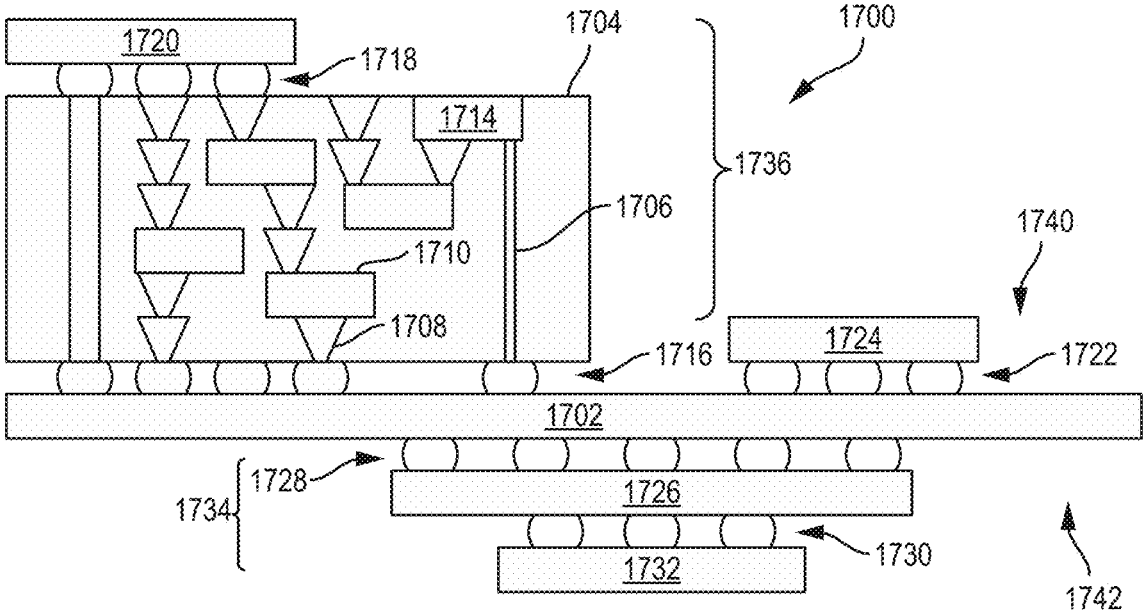
FIG. 18 is a side, cross-sectional view of an IC device assembly that may include an antenna board, in accordance with any of the embodiments disclosed herein.

FIG. 18 is a cross-sectional side view of an IC device assembly 1700 that may include one or more of the antenna boards 100 disclosed herein. In particular, any suitable ones of the antenna boards 100 disclosed herein may take the place of any of the components of the IC device assembly 1700 (e.g., an antenna board 100 may take the place of any of the IC packages of the IC device assembly 1700).

The IC device assembly 1700 includes a number of components disposed on a circuit board 1702 (which may be, e.g., a motherboard). The IC device assembly 1700 includes components disposed on a first face 1740 of the circuit board 1702 and an opposing second face 1742 of the circuit board 1702; generally, components may be disposed on one or both faces 1740 and 1742.

In some embodiments, the circuit board 1702 may be a PCB including multiple metal layers separated from one another by layers of dielectric material and interconnected by electrically conductive vias. Any one or more of the metal layers may be formed in a desired circuit pattern to route electrical signals (optionally in conjunction with other metal layers) between the components coupled to the circuit board 1702. In other embodiments, the circuit board 1702 may be a non-PCB substrate.

The IC device assembly 1700 illustrated in FIG. 18 includes a package-on-interposer structure 1736 coupled to the first face 1740 of the circuit board 1702 by coupling components 1716. The coupling components 1716 may electrically and mechanically couple the package-on-interposer structure 1736 to the circuit board 1702, and may include solder balls (as shown in FIG. 18), male and female portions of a socket, an adhesive, an underfill material, and/or any other suitable electrical and/or mechanical coupling structure.

The package-on-interposer structure 1736 may include an IC package 1720 coupled to an interposer 1704 by coupling components 1718. The coupling components 1718 may take any suitable form for the application, such as the forms discussed above with reference to the coupling components 1716. Although a single IC package 1720 is shown in FIG. 18, multiple IC packages may be coupled to the interposer 1704; indeed, additional interposers may be coupled to the interposer 1704. The interposer 1704 may provide an intervening substrate used to bridge the circuit board 1702 and the IC package 1720. The IC package 1720 may be or include, for example, a die (the die 1502 of FIG. 16), an IC device (e.g., the IC device 1600 of FIG. 17), or any other suitable component. Generally, the interposer 1704 may spread a connection to a wider pitch or reroute a connection to a different connection. For example, the interposer 1704 may couple the IC package 1720 (e.g., a die) to a set of ball grid array (BGA) conductive contacts of the coupling components 1716 for coupling to the circuit board 1702. In the embodiment illustrated in FIG. 18, the IC package 1720 and the circuit board 1702 are attached to opposing sides of the interposer 1704; in other embodiments, the IC package 1720 and the circuit board 1702 may be attached to a same side of the interposer 1704. In some embodiments, three or more components may be interconnected by way of the interposer 1704.

In some embodiments, the interposer 1704 may be formed as a PCB, including multiple metal layers separated from one another by layers of dielectric material and interconnected by electrically conductive vias. In some embodiments, the interposer 1704 may be formed of an epoxy resin, a fiberglass-reinforced epoxy resin, an epoxy resin with inorganic fillers, a ceramic material, or a polymer material such as polyimide. In some embodiments, the interposer 1704 may be formed of alternate rigid or flexible materials that may include the same materials described above for use in a semiconductor substrate, such as silicon, germanium, and other group III-V and group IV materials. The interposer 1704 may include metal interconnects 1708 and vias 1710, including but not limited to through-silicon vias (TSVs) 1706. The interposer 1704 may further include embedded devices 1714, including both passive and active devices. Such devices may include, but are not limited to, capacitors, decoupling capacitors, resistors, inductors, fuses, diodes, transformers, sensors, electrostatic discharge (ESD) devices, and memory devices. More complex devices such as RF devices, power amplifiers, power management devices, antennas, arrays, sensors, and microelectromechanical systems (MEMS) devices may also be formed on the interposer 1704. The package-on-interposer structure 1736 may take the form of any of the package-on-interposer structures known in the art.

The IC device assembly 1700 may include an IC package 1724 coupled to the first face 1740 of the circuit board 1702 by coupling components 1722. The coupling components 1722 may take the form of any of the embodiments discussed above with reference to the coupling components 1716, and the IC package 1724 may take the form of any of the embodiments discussed above with reference to the IC package 1720.

The IC device assembly 1700 illustrated in FIG. 18 includes a package-on-package structure 1734 coupled to the second face 1742 of the circuit board 1702 by coupling components 1728. The package-on-package structure 1734 may include an IC package 1726 and an IC package 1732 coupled together by coupling components 1730 such that the IC package 1726 is disposed between the circuit board 1702 and the IC package 1732. The coupling components 1728 and 1730 may take the form of any of the embodiments of the coupling components 1716 discussed above, and the IC packages 1726 and 1732 may take the form of any of the embodiments of the IC package 1720 discussed above. The package-on-package structure 1734 may be configured in accordance with any of the package-on-package structures known in the art.

Figure 19:
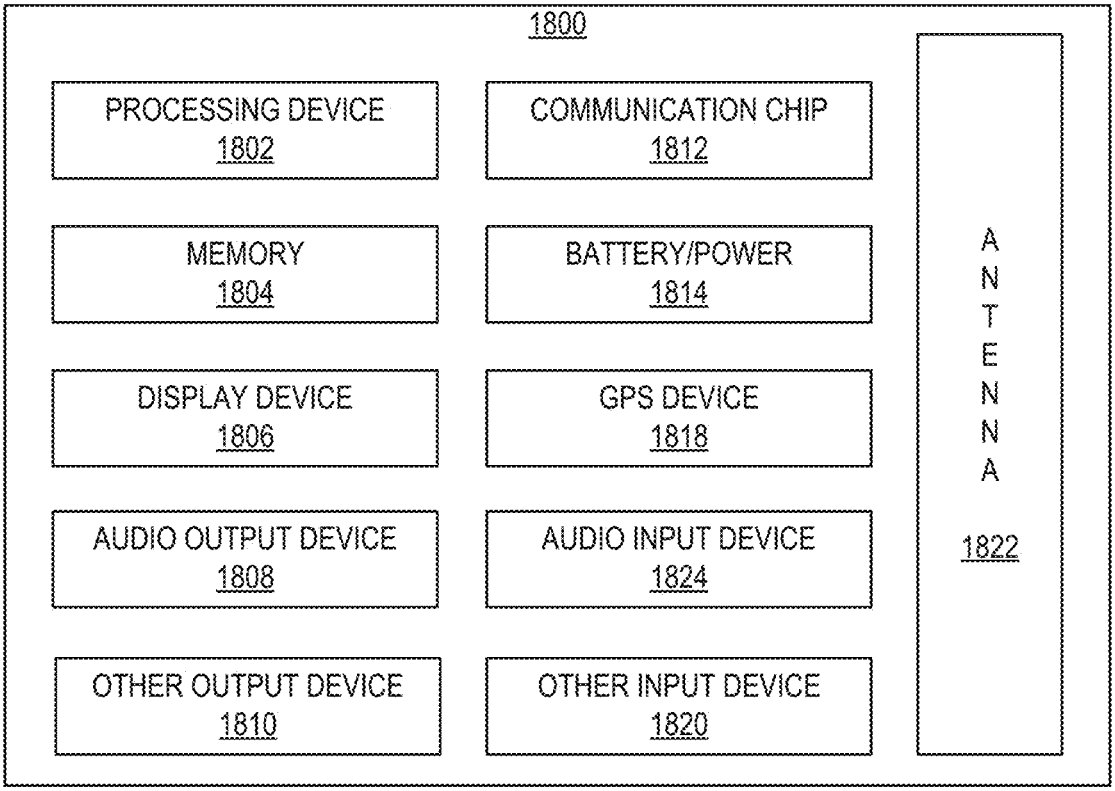
FIG. 19 is a block diagram of an example communication device that may include an antenna board, in accordance with any of the embodiments disclosed herein.

FIG. 19 is a block diagram of an example communication device 1800 that may include one or more antenna boards 100, in accordance with any of the embodiments disclosed herein. For example, the communication device 151 (FIG. 17) may be an example of the communication device 1800. Any suitable ones of the components of the communication device 1800 may include one or more of the IC packages 1650, IC devices 1600, or dies 1502 disclosed herein. A number of components are illustrated in FIG. 19 as included in the communication device 1800, but any one or more of these components may be omitted or duplicated, as suitable for the application. In some embodiments, some or all of the components included in the communication device 1800 may be attached to one or more motherboards. In some embodiments, some or all of these components are fabricated onto a single system-on-a-chip (SoC) die.

Additionally, in various embodiments, the communication device 1800 may not include one or more of the components illustrated in FIG. 19, but the communication device 1800 may include interface circuitry for coupling to the one or more components. For example, the communication device 1800 may not include a display device 1806, but may include display device interface circuitry (e.g., a connector and driver circuitry) to which a display device 1806 may be coupled. In another set of examples, the communication device 1800 may not include an audio input device 1824 or an audio output device 1808, but may include audio input or output device interface circuitry (e.g., connectors and supporting circuitry) to which an audio input device 1824 or audio output device 1808 may be coupled.

The communication device 1800 may include a processing device 1802 (e.g., one or more processing devices). As used herein, the term "processing device" or "processor" may refer to any device or portion of a device that processes electronic data from registers and/or memory to transform that electronic data into other electronic data that may be stored in registers and/or memory. The processing device 1802 may include one or more digital signal processors (DSPs), application-specific integrated circuits (ASICs), central processing units (CPUs), graphics processing units (GPUs), cryptoprocessors (specialized processors that execute cryptographic algorithms within hardware), server processors, or any other suitable processing devices. The communication device 1800 may include a memory 1804, which may itself include one or more memory devices such as volatile memory (e.g., dynamic random access memory (DRAM)), nonvolatile memory (e.g., read-only memory (ROM)), flash memory, solid state memory, and/or a hard drive. In some embodiments, the memory 1804 may include memory that shares a die with the processing device 1802. This memory may be used as cache memory and may include embedded dynamic random access memory (eDRAM) or spin transfer torque magnetic random access memory (STT-MRAM).

In some embodiments, the communication device 1800 may include a communication module 1812 (e.g., one or more communication modules). For example, the communication module 1812 may be configured for managing wireless communications for the transfer of data to and from the communication device 1800. The term "wireless" and its derivatives may be used to describe circuits, devices, systems, methods, techniques, communications channels, etc., that may communicate data through the use of modulated electromagnetic radiation through a nonsolid medium. The term does not imply that the associated devices do not contain any wires, although in some embodiments they might not. The communication module 1812 may be, or may include, any of the antenna boards 100 disclosed herein.

The communication module 1812 may implement any of a number of wireless standards or protocols, including but not limited to Institute for Electrical and Electronic Engineers (IEEE) standards including Wi-Fi (IEEE 802.11 family), IEEE 802.16 standards (e.g., IEEE 802.16-2005 Amendment), Long-Term Evolution (LTE) project along with any amendments, updates, and/or revisions (e.g., advanced LTE project, ultra mobile broadband (UMB) project (also referred to as "3GPP2"), etc.). IEEE 802.16 compatible Broadband Wireless Access (BWA) networks are generally referred to as WiMAX networks, an acronym that stands for Worldwide Interoperability for Microwave Access, which is a certification mark for products that pass conformity and interoperability tests for the IEEE 802.16 standards. The communication module 1812 may operate in accordance with a Global System for Mobile Communication (GSM), General Packet Radio Service (GPRS), Universal Mobile Telecommunications System (UMTS), High Speed Packet Access (HSPA), Evolved HSPA (E-HSPA), or LTE network. The communication module 1812 may operate in accordance with Enhanced Data for GSM Evolution (EDGE), GSM EDGE Radio Access Network (GERAN), Universal Terrestrial Radio Access Network (UTRAN), or Evolved UTRAN (E-UTRAN). The communication module 1812 may operate in accordance with Code Division Multiple Access (CDMA), Time Division Multiple Access (TDMA), Digital Enhanced Cordless Telecommunications (DECT), Evolution-Data Optimized (EV-DO), and derivatives thereof, as well as any other wireless protocols that are designated as 3G, 4G, 5G, and beyond. The communication module 1812 may operate in accordance with other wireless protocols in other embodiments. The communication device 1800 may include an antenna 1822 to facilitate wireless communications and/or to receive other wireless communications (such as AM or FM radio transmissions).

In some embodiments, the communication module 1812 may manage wired communications, such as electrical, optical, or any other suitable communication protocols (e.g., the Ethernet). As noted above, the communication module 1812 may include multiple communication modules. For instance, a first communication module 1812 may be dedicated to shorter-range wireless communications such as Wi-Fi or Bluetooth, and a second communication module 1812 may be dedicated to longer-range wireless communications such as global positioning system (GPS), EDGE, GPRS, CDMA, WiMAX, LTE, EV-DO, or others. In some embodiments, a first communication module 1812 may be dedicated to wireless communications, and a second communication module 1812 may be dedicated to wired communications. In some embodiments, the communication module 1812 may include an antenna board 100 that supports millimeter wave communication.

The communication device 1800 may include battery/power circuitry 1814. The battery/power circuitry 1814 may include one or more energy storage devices (e.g., batteries or capacitors) and/or circuitry for coupling components of the communication device 1800 to an energy source separate from the communication device 1800 (e.g., AC line power).

The communication device 1800 may include a display device 1806 (or corresponding interface circuitry, as discussed above). The display device 1806 may include any visual indicators, such as a heads-up display, a computer monitor, a projector, a touchscreen display, a liquid crystal display (LCD), a light-emitting diode display, or a flat panel display.

The communication device 1800 may include an audio output device 1808 (or corresponding interface circuitry, as discussed above). The audio output device 1808 may include any device that generates an audible indicator, such as speakers, headsets, or earbuds.

The communication device 1800 may include an audio input device 1824 (or corresponding interface circuitry, as discussed above). The audio input device 1824 may include any device that generates a signal representative of a sound, such as microphones, microphone arrays, or digital instruments (e.g., instruments having a musical instrument digital interface (MIDI) output).

The communication device 1800 may include a GPS device 1818 (or corresponding interface circuitry, as discussed above). The GPS device 1818 may be in communication with a satellite-based system and may receive a location of the communication device 1800, as known in the art.

The communication device 1800 may include an other output device 1810 (or corresponding interface circuitry, as discussed above). Examples of the other output device 1810 may include an audio codec, a video codec, a printer, a wired or wireless transmitter for providing information to other devices, or an additional storage device.

The communication device 1800 may include an other input device 1820 (or corresponding interface circuitry, as discussed above). Examples of the other input device 1820 may include an accelerometer, a gyroscope, a compass, an image capture device, a keyboard, a cursor control device such as a mouse, a stylus, a touchpad, a bar code reader, a Quick Response (QR) code reader, any sensor, or a radio frequency identification (RFID) reader.

The communication device 1800 may have any desired form factor, such as a handheld or mobile communication device (e.g., a cell phone, a smart phone, a mobile internet device, a music player, a tablet computer, a laptop computer, a netbook computer, an ultrabook computer, a personal digital assistant (PDA), an ultra mobile personal computer, etc.), a desktop communication device, a server or other networked computing component, a printer, a scanner, a monitor, a set-top box, an entertainment control unit, a vehicle control unit, a digital camera, a digital video recorder, or a wearable communication device. In some embodiments, the communication device 1800 may be any other electronic device that processes data.

The following paragraphs provide examples of various ones of the embodiments disclosed herein.

Example 1 is an antenna board, including: a substrate including an antenna feed structure; an antenna patch, wherein the antenna patch is a millimeter wave antenna patch; and an air cavity between the antenna patch and the substrate.

Example 2 may include the subject matter of Example 1, and may further specify that the antenna feed structure includes a stripline feed structure.

Example 3 may include the subject matter of any of Examples 1-2, and may further specify that the substrate has a first surface and a second surface, the second surface is opposite to the first surface, the second surface is between the first surface and the antenna patch, and a ground plane is at the second surface.

Example 4 may include the subject matter of Example 3, and may further specify that the ground plane has one or more apertures.

Example 5 may include the subject matter of any of Examples 1-4, and may further specify that the substrate has a thickness between 300 microns and 800 microns.

Example 6 may include the subject matter of any of Examples 1-5, and may further specify that the antenna patch is disposed over a recess in the substrate.

Example 7 may include the subject matter of any of Examples 1-6, and may further specify that the antenna patch is coupled to the substrate by an adhesive.

Example 8 may include the subject matter of any of Examples 1-7, and may further specify that the antenna patch is coupled to the substrate by solder.

Example 9 may include the subject matter of any of Examples 1-8, and may further specify that the antenna patch is coupled to a patch board, and the patch board is between the antenna patch and the air cavity.

Example 10 may include the subject matter of any of Examples 1-8, and may further specify that the antenna patch is coupled to a patch board, and the antenna patch is between the patch board and the air cavity.

Example 11 may include the subject matter of any of Examples 1-10, and may further specify that the antenna patch is a first antenna patch, the antenna board further includes a second antenna patch, and the first antenna patch is between the substrate and the second antenna patch.

Example 12 may include the subject matter of Example 11, and may further include: a patch board having a first face and an opposing second face; wherein the first antenna patch is coupled to the first face of the patch board, and the second antenna patch is coupled to the second face of the patch board.

Example 13 may include the subject matter of Example 12, and may further specify that the patch board is coupled to the substrate by an adhesive.

Example 14 may include the subject matter of any of Examples 12-13, and may further specify that the patch board is coupled to the substrate by solder.

Example 15 may include the subject matter of Example 11-14, and may further specify that the air cavity is a first air cavity, the antenna board further includes a second air cavity, and the second air cavity is between the first antenna patch and the second antenna patch.

Example 16 may include the subject matter of Example 15, and may further include: a patch board having a first face and an opposing second face; wherein the first antenna patch is coupled to the first face of the patch board, the second antenna patch is coupled to the second face of the patch board, and the patch board includes the second air cavity.

Example 17 may include the subject matter of Example 16, and may further specify that the patch board includes at least one opening in the second face.

Example 18 may include the subject matter of any of Examples 11-17, and may further include: a third antenna patch, wherein the second antenna patch is between the first antenna patch and the third antenna patch.

Example 19 may include the subject matter of Example 18, and may further include: a patch board having a first face and an opposing second face; wherein the air cavity is a first air cavity, the antenna board further includes a second air cavity, the second air cavity is between the first antenna patch and the second antenna patch, the first antenna patch is coupled to the first face of the patch board, the second antenna patch is coupled to the second face of the patch board, and the patch board includes the second air cavity.

Example 20 may include the subject matter of Example 19, and may further specify that the third antenna patch is coupled to the second face of the patch board by solder.

Example 21 may include the subject matter of any of Examples 1-20, and may further specify that the antenna board has a thickness between 700 microns and 1 millimeter.

Example 22 may include the subject matter of any of Examples 1-21, and may further specify that the antenna board does not include a conductive material pathway between the antenna patch and the substrate.

Example 23 is an antenna board, including: a ground plane having an aperture therein; an antenna patch, wherein the antenna patch is a millimeter wave antenna patch; and an air cavity between the antenna patch and the aperture.

Example 24 may include the subject matter of Example 23, and may further specify that the aperture has an I-shape.

Example 25 may include the subject matter of any of Examples 23-24, and may further specify that the ground plane has multiple apertures therein.

Example 26 may include the subject matter of any of Examples 23-25, and may further specify that the ground plane has a first I-shaped aperture and a second I-shaped aperture oriented at right-angles to each other.

Example 27 may include the subject matter of any of Examples 23-26, and may further specify that the air cavity has a thickness between 100 microns and 300 microns.

Example 28 may include the subject matter of any of Examples 23-27, and may further include a stripline feed structure.

Example 29 may include the subject matter of any of Examples 23-28, and may further specify that the antenna patch has an aperture therein.

Example 30 may include the subject matter of Example 29, and may further specify that the aperture in the antenna patch has a cross shape.

Example 31 may include the subject matter of any of Examples 23-30, and may further specify that the ground plane is at a surface of a substrate, and the substrate includes an antenna feed structure.

Example 32 may include the subject matter of Example 31, and may further specify that the antenna patch is disposed over a recess in the substrate.

Example 33 may include the subject matter of any of Examples 23-32, and may further specify that the antenna patch has a thickness between 5 microns and 30 microns.

Example 34 may include the subject matter of any of Examples 23-33, and may further specify that the antenna patch is a first antenna patch, the antenna board further includes a second antenna patch, and the first antenna patch is between the aperture and the second antenna patch.

Example 35 may include the subject matter of Example 34, and may further include: a patch board having a first face and an opposing second face; wherein the first antenna patch is coupled to the first face of the patch board, and the second antenna patch is coupled to the second face of the patch board.

Example 36 may include the subject matter of Example 34, and may further specify that the air cavity is a first air cavity, the antenna board further includes a second air cavity, and the second air cavity is between the first antenna patch and the second antenna patch.

Example 37 may include the subject matter of Example 36, and may further include: a patch board having a first face and an opposing second face; wherein the first antenna patch is coupled to the first face of the patch board, the second antenna patch is coupled to the second face of the patch board, and the patch board includes the second air cavity.

Example 38 may include the subject matter of Example 37, and may further specify that the patch board includes at least one opening in the second face.

Example 39 may include the subject matter of any of Examples 34-38, and may further include: a third antenna patch, wherein the second antenna patch is between the first antenna patch and the third antenna patch.

Example 40 may include the subject matter of Example 39, and may further include: a patch board having a first face and an opposing second face; wherein the air cavity is a first air cavity, the antenna board further includes a second air cavity, the second air cavity is between the first antenna patch and the second antenna patch, the first antenna patch is coupled to the first face of the patch board, the second antenna patch is coupled to the second face of the patch board, and the patch board includes the second air cavity.

Example 41 may include the subject matter of Example 40, and may further specify that the third antenna patch is coupled to the second face of the patch board by solder.

Example 42 may include the subject matter of any of Examples 23-41, and may further specify that the antenna board has a thickness between 700 microns and 1 millimeter.

Example 43 is an antenna module, including: an integrated circuit (IC) package; and an antenna board, wherein the antenna board is coupled to the IC package, and the antenna board includes a substrate including an antenna feed structure, an antenna patch, wherein the antenna patch is a millimeter wave antenna patch, and an air cavity between the antenna patch and the substrate.

Example 44 may include the subject matter of Example 43, and may further specify that the antenna feed structure includes a stripline feed structure.

Example 45 may include the subject matter of any of Examples 43-44, and may further specify that the substrate has a first surface and a second surface, the second surface is opposite to the first surface, the second surface is between the first surface and the antenna patch, a ground plane is at the second surface, and the ground plane includes at least one aperture.

Example 46 may include the subject matter of Example 45, and may further specify that the ground plane has multiple apertures.

Example 47 may include the subject matter of any of Examples 43-46, and may further specify that the antenna patch is a first antenna patch, the antenna board further includes a second antenna patch, and the first antenna patch is between the substrate and the second antenna patch.

Example 48 may include the subject matter of Example 47, and may further include: a patch board having a first face and an opposing second face; wherein the first antenna patch is coupled to the first face of the patch board, and the second antenna patch is coupled to the second face of the patch board.

Example 49 may include the subject matter of any of Examples 47-48, and may further specify that the air cavity is a first air cavity, the antenna board further includes a second air cavity, and the second air cavity is between the first antenna patch and the second antenna patch.

Example 50 may include the subject matter of Example 49, and may further include: a patch board having a first face and an opposing second face; wherein the first antenna patch is coupled to the first face of the patch board, the second antenna patch is coupled to the second face of the patch board, and the patch board includes the second air cavity.

Example 51 may include the subject matter of any of Examples 47-50, and may further include: a third antenna patch, wherein the second antenna patch is between the first antenna patch and the third antenna patch.

Example 52 may include the subject matter of any of Examples 43-51, and may further specify that the antenna board has a thickness between 700 microns and 1 millimeter.

Example 53 may include the subject matter of any of Examples 43-52, and may further specify that the antenna board does not include a conductive material pathway between the antenna patch and the substrate.

Example 54 may include the subject matter of any of Examples 43-53, and may further specify that the IC package includes a radio frequency (RF) communication die.

Example 55 may include the subject matter of any of Examples 43-54, and may further specify that the IC package includes a memory device programmed with instructions to execute beam forming, scanning, and/or codebook functions.

Example 56 is a communication device, including: a housing; and an antenna board in the housing, wherein the antenna board includes a substrate including an antenna feed structure, an antenna patch, wherein the antenna patch is a millimeter wave antenna patch, and an air cavity between the antenna patch and the substrate.

Example 57 may include the subject matter of Example ples 56, and may further specify that the communication device is a handheld communication device.

Example 58 may include the subject matter of Example 56, and may further specify that the communication device includes a router.

Example 59 may include the subject matter of any of Examples 56-58, and may further include: a display.

Example 60 may include the subject matter of Example 59, and may further specify that the display is a touch display.

Example 61 may include the subject matter of any of Examples 56-60, and may further specify that the housing includes a metal chassis having an opening, and the antenna patch is proximate to the opening.

The invention claimed is:

1. An antenna board, comprising:
a substrate including an antenna feed structure;
an antenna patch, wherein the antenna patch is a millimeter wave antenna patch; and
an air cavity between the antenna patch and the substrate, wherein:
the antenna patch is disposed over a recess in the substrate and wherein a bottom of the recess includes a ground plane, and
the ground plane is a continuous ground plane at a surface of the bottom of the recess.

2. The antenna board of claim 1, wherein the antenna patch is a first antenna patch, the antenna board further includes a second antenna patch, and the first antenna patch is between the substrate and the second antenna patch.

3. The antenna board of claim 2, further comprising:
a patch board having a first face and an opposing second face;
wherein the first antenna patch is coupled to the first face of the patch board, and the second antenna patch is coupled to the second face of the patch board.

4. The antenna board of claim 3, wherein the patch board is coupled to the substrate by an adhesive.

5. The antenna board of claim 2, wherein the air cavity is a first air cavity, the antenna board further includes a second air cavity, and the second air cavity is between the first antenna patch and the second antenna patch.

6. The antenna board of claim 5, further comprising:
a patch board having a first face and an opposing second face;
wherein the first antenna patch is coupled to the first face of the patch board, the second antenna patch is coupled to the second face of the patch board, and the patch board includes the second air cavity.

7. The antenna board of claim 6, wherein the patch board includes at least one opening in the second face.

8. The antenna board of claim 7, wherein the at least one opening is an air cavity between a portion of the patch board to which the first antenna patch is coupled and a portion of the patch board to which the second antenna patch is coupled.

9. The antenna board of claim 2, further comprising:
a first patch board having a first face and an opposing second face;
a second patch board having a first face and an opposing second face;
conductive contacts at the first face of the second patch board; and
conductive contacts at a surface of the substrate,
wherein:
the first face of the first patch board is closer to the bottom of the recess than the second face of the first patch board,
the first antenna patch is coupled to the second face of the first patch board,
the second antenna patch is coupled to the first face of the second patch board, and
the conductive contacts at the first face of the second patch board are coupled to the conductive contacts at the surface of the substrate.

10. The antenna board of claim 1, wherein the antenna feed structure is a stripline feed structure.

11. The antenna board of claim 1, wherein the substrate has a thickness between 300 microns and 800 microns.

12. The antenna board of claim 1, wherein the first face of the first patch board is suspended over the recess and over the substrate.

13. The antenna board of claim 12, wherein the air cavity is a first air cavity, the antenna board further includes a second air cavity, and the second air cavity is between the first antenna patch and the second antenna patch.

14. An antenna module, comprising:
an integrated circuit (IC) package; and
an antenna board, wherein the antenna board is coupled to the IC package, and the antenna board includes:
a substrate including an antenna feed structure,
an antenna patch, wherein the antenna patch is a millimeter wave antenna patch, and
an air cavity between the antenna patch and the substrate,
wherein:
the antenna patch is disposed over a recess in the substrate,
a bottom of the recess includes a ground plane, and
the ground plane is a continuous ground plane at a surface of the bottom of the recess.

15. The antenna module of claim 14, wherein the IC package includes a radio frequency (RF) communication die.

16. The antenna module of claim 14, wherein the antenna patch is coupled to a patch board by an adhesive, the patch board being disposed over the recess in the substrate.

17. A communication device, comprising:
a housing; and
an antenna board in the housing, wherein the antenna board includes:
a substrate including an antenna feed structure, an antenna patch, wherein the antenna patch is a millimeter wave antenna patch, and an air cavity between the antenna patch and the substrate, wherein:

the antenna patch is disposed over a recess in the substrate, a bottom of the recess includes a ground plane, and the ground plane is a continuous ground plane at a surface of the bottom of the recess.

18. The communication device of claim 17, wherein the communication device is a handheld communication device.

19. The communication device of claim 17, further comprising a display.

20. The communication device of claim 17, wherein the housing includes a metal chassis having an opening, and the antenna patch is proximate to the opening.

* * * * *